United States Patent [19]

Hunter et al.

[11] Patent Number: 4,503,741

[45] Date of Patent: Mar. 12, 1985

[54] BRIDGE TYPE PUNCH PRESS

[75] Inventors: James R. Hunter, Chadds Ford; S. James Lazzarotti, Broomall, both of Pa.

[73] Assignee: The Warner & Swasey Company, Cleveland, Ohio

[21] Appl. No.: 401,444

[22] Filed: Jul. 26, 1982

[51] Int. Cl.[3] ..... B26D 5/08; B21J 7/46

[52] U.S. Cl. ..... 83/549; 83/551; 83/618; 72/442; 72/444; 72/456

[58] Field of Search ..... 83/71, 405, 549, 550, 83/551, 552, 618; 29/568, 26 A; 72/442, 444, 446, 448, 456, 481

[56] References Cited

U.S. PATENT DOCUMENTS

| | | | |
|---|---|---|---|
| 3,449,991 | 6/1969 | Daniels | 83/71 |
| 3,745,646 | 7/1973 | Kristiansson | 29/568 |
| 4,165,669 | 8/1979 | Brown et al. | 83/552 |
| 4,168,644 | 9/1979 | Leibinger et al. | 83/573 |
| 4,220,062 | 9/1980 | Blanz | 83/71 |
| 4,250,785 | 2/1981 | Morishita et al. | 83/552 |

*Primary Examiner*—Paul A. Bell
*Assistant Examiner*—Taylor J. Ross
*Attorney, Agent, or Firm*—Howard G. Massung

[57] ABSTRACT

A punch press (20), for punching a workpiece, utilizing an elongated punch support which is formed from removable interconnected punch cartridges (92) and an elongated die support which is formed from removable interconnected die cartridges (94). A punch head (32) is supported from a frame (30) which spans the punching area. A two axis positioning system is provided for positioning the sheet metal workpiece within the punching area beneath the punch head. Punch head (32) through appropriate mechanical interposer (160) engages a punch which in conjunction with an associated die, positioned there beneath, forms a hole in the workpiece. The elongated punch sections (92) and die sections (94) can be moved out of the punch press frame, disengaged and removed or replaced. The first punch section (92) and first die section (94) engage driver sections (192, 194) which are disposed in the frame (30). The driver sections (192, 194) are then moved to bring the tool supporting sections (92, 94) into the press. A second punching head (34) which is separated by the length of one cartridge (92, 94) can be provided for double punching. A disappearing table (95) which is engaged by the last die section (94) brought into the press is utilized for supporting the worksheet. Each cartridge section includes at least two rows of tools. Aligning holes for all tools are on one side of each tool cartridge (92, 94). Before punching the aligning holes are engaged by an index pin to provide high accuracy alignment of the selected punch and die.

27 Claims, 30 Drawing Figures

BRIDGE TYPE PUNCH PRESS

CROSS REFERENCE TO RELATED APPLICATIONS

This application is related to co-pending U.S. patent application Ser. No. 401,446 entitled "Universal Sheet Metal Holder" and U.S. patent application Ser. No. 401,445 entitled "Punch Head for a Punch Press" both of which are assigned to the assignee of the present invention.

BACKGROUND OF THE INVENTION

1. Technical Field

This invention relates to metal working and more particularly to an improved bridge type sheet metal punching press.

2. Background Art

Sheet metal punch presses with a bridge type frame supporting a punching head have been known for some time. U.S. Pat. No. 3,449,991 teaches a turret type punch press wherein the punching head is supported from a frame which extends across the workpiece support table. U.S. Pat. No. 4,220,062 teaches a punch press which utilizes elongated tool supporting members which can be moved back and forth to select the proper tool. U.S. Pat. No. 4,168,644 teaches a stamping machine including a tool changing mechanism.

DISCLOSURE OF THE INVENTION

The present invention teaches a punch press having a punching head, supported on a bridge type frame, which selectively engages tools supported in an elongated sectionalized cartridge. The bridge frame support spans a work area in which a worksheet is positioned along two axes, in the X-Y directions. The linear sectionalized cartridge system includes at least two rows of tooling which are offset. Punch cartridges and associated die cartridges are movable together in a linear fashion to move the desired tool under the punching head. Use of sectionalized linear cartridges permit easy off-line tool changing.

A workpiece support table is securely fastened to one end of the main bridge type frame to form an integral frame for the punch press. The bridge frame includes two support areas and the end of the workpiece support table away from the bridge frame includes another support area to provide a three area support for the punch press.

A second punching head can be provided on the bridge-type support frame to permit simultaneous making of two parts. The second punching head is spaced from the first punching head by one cartridge length so that two identical tooled cartridges can be supported in series. This permits the simultaneous making of two identical parts.

BRIEF DESCRIPTION OF THE DRAWINGS

For a better understanding of the invention, reference may be had to the preferred embodiment exemplary of the invention shown in the accompanying drawings in which.

BEST MODE FOR CARRYING OUT THE INVENTION

Figure 1:
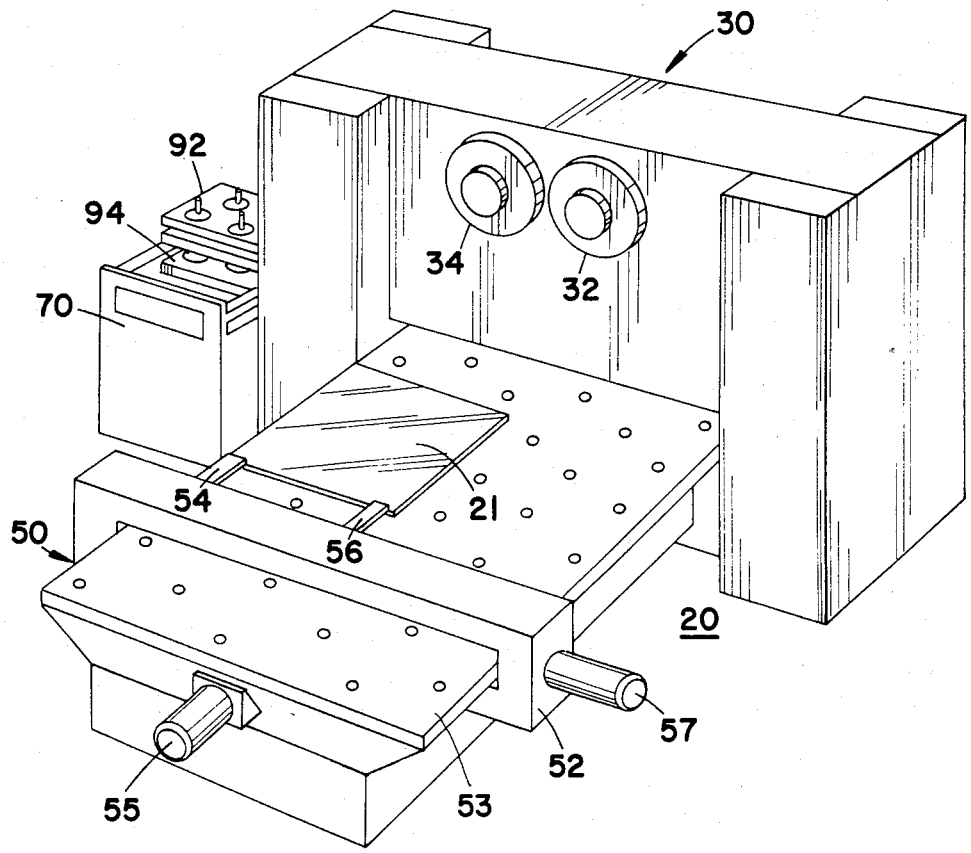
FIG. 1 is an isometric view of a punch press constructed according to the teaching of the present invention.

Referring now to the drawings, and FIGS. 1 thru 4 in particular, there is shown a punch press 20 constructed according to the teaching of the present invention. Punch press 20 is constructed with a bridge frame press assembly 30 having a two axes, X-Y, sheet positioning system 50 integrally connected thereto. Preferably bridge frame 30 supports a pair of punching heads 32 and 34. Punch head 32 is the standard punch head and punch head 34 is optional for twin punching. Twin punching heads 32 and 34 are substantially identical and operate separately or in parallel to double machine productivity.

Figure 10:
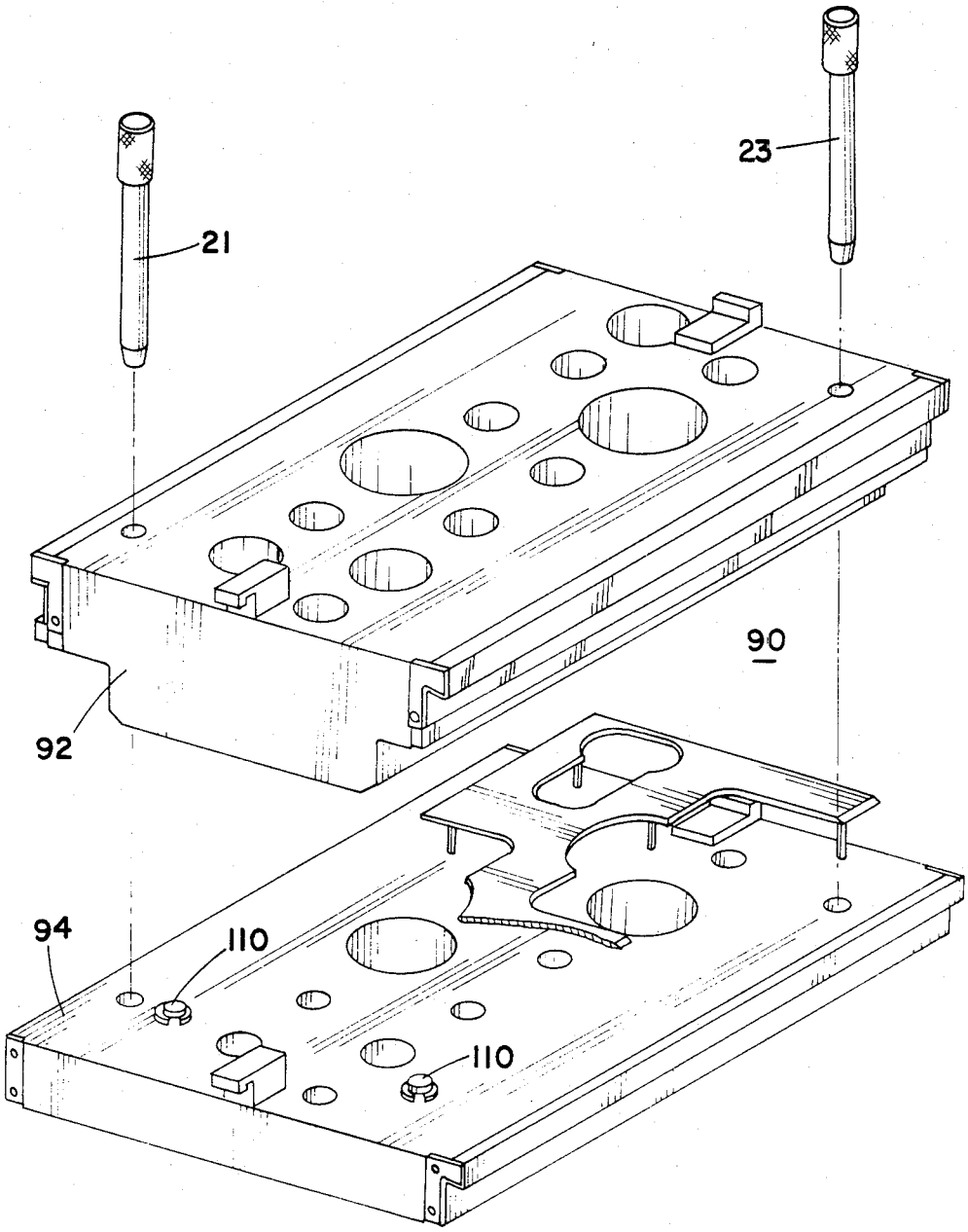
FIG. 10 is an isometric view of an upper and lower cartridge.
Figure 11:
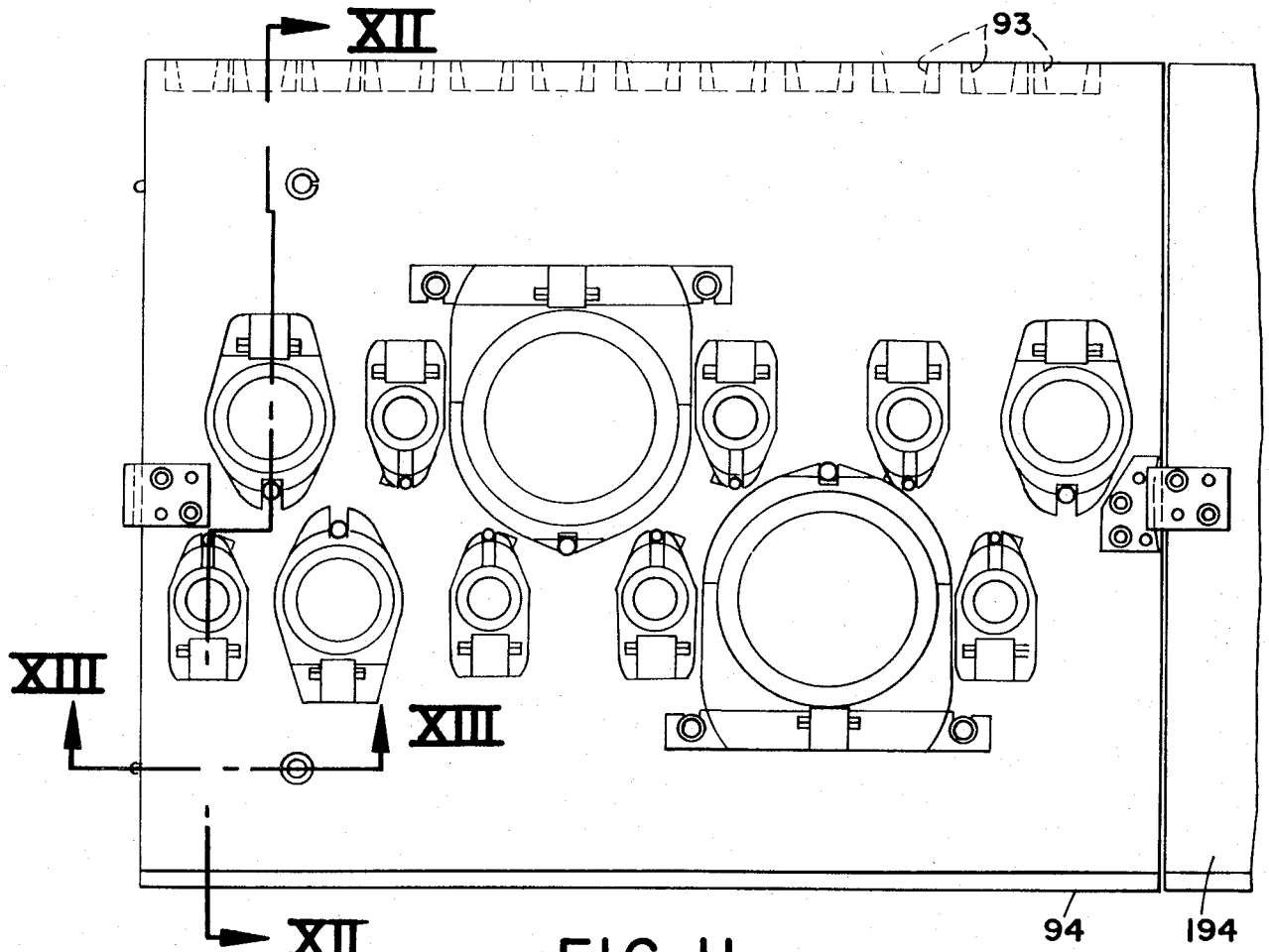
FIG. 11 is a top view of the lower die cartridge and driver.
Figure 12:
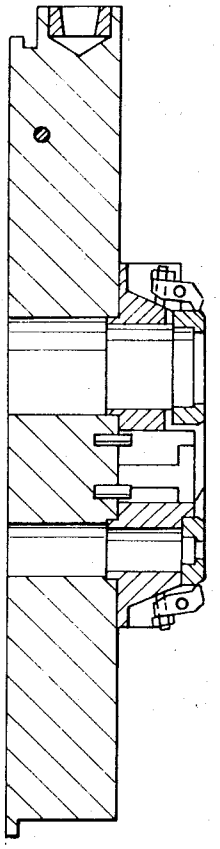
FIG. 12 is a view of FIG. 11 along the line XII—XII.

A cartridge tooling arrangement 90, as shown in FIG. 10, consisting of a punch cartridge 92 and a die cartridge 94, is positionable within bridge frame 30. The punch holding cartridge 92 is provided for holding punches, and the die holding cartridge 94 is provided for supporting appropriate dies used with the punches.

Figure 21:
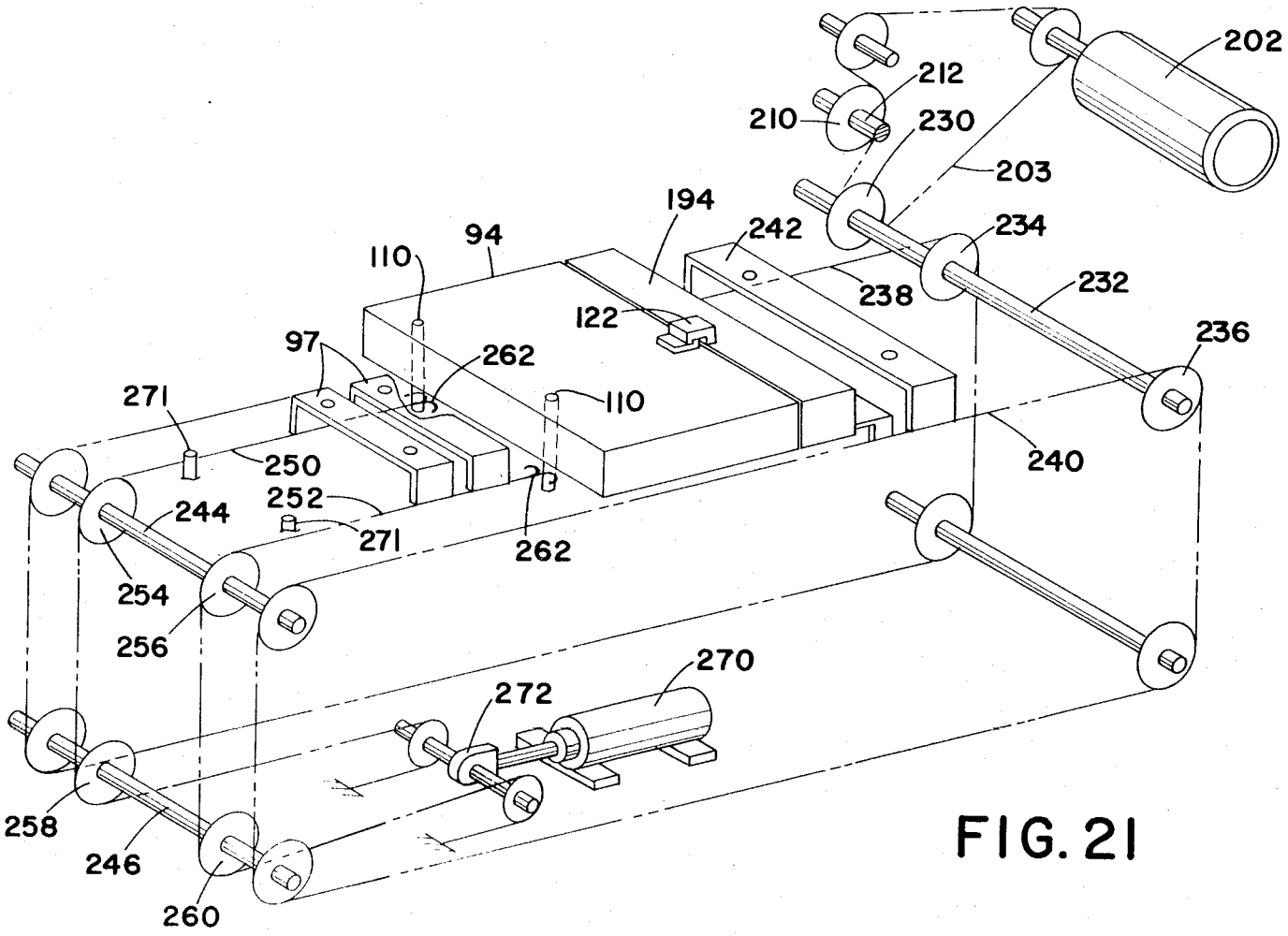
FIG. 21 is a diagramatic view of the cartridge drive system showing the die cartridge.
Figure 22:
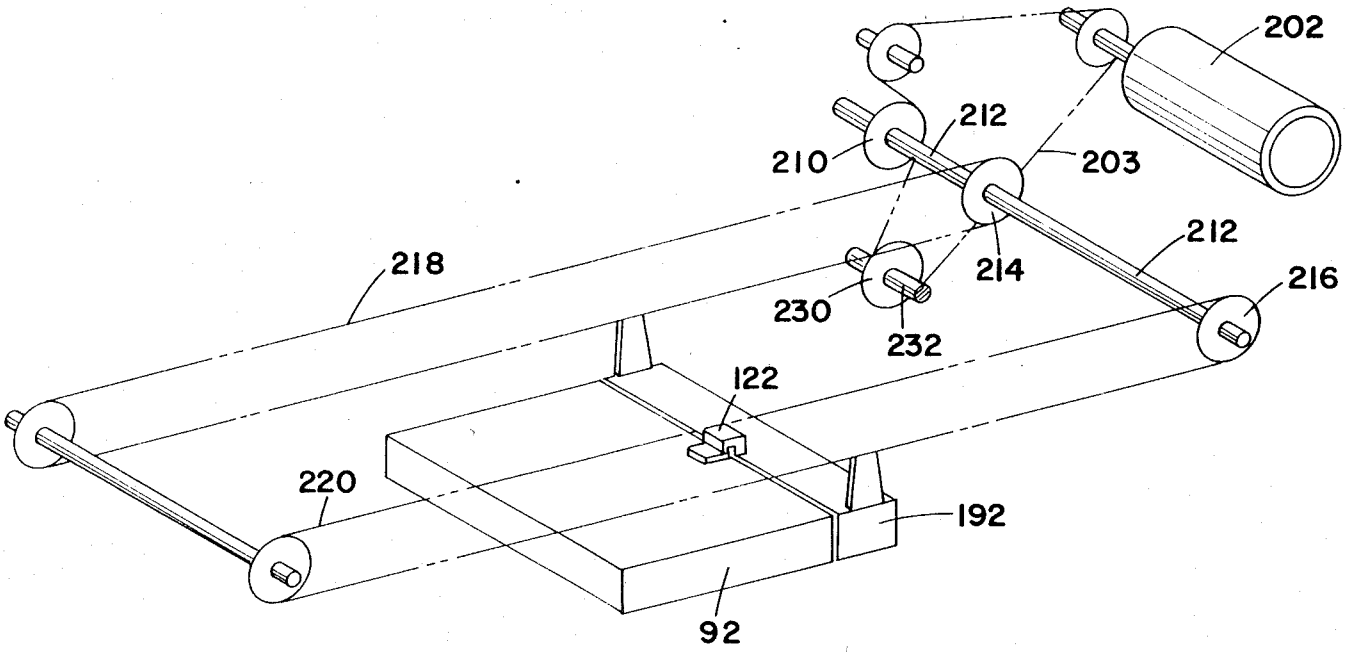
FIG. 22 is a diagramatic view of the cartridge drive system showing the punch cartridge.

The punch cartridge 92 and die cartridge 94 are synchronously positionable within frame 30 to bring a selected punch into position for being activated, through an appropriate mechanism, by one of the punching heads 32, 34. During operation a suitable die for use with the selected punch is positioned to receive the activated punch. As shown in FIGS. 21 and 22 and as will be described in more detail hereinafter the punch cartridge drive and die cartridge drive are synchronized together and driven from a common motor through drive chains whereby each punch is always directly located above its associated die. The punch and die cartridges 92, 94 are moved back and forth in lock step so that when the desired punch is moved to a position under the punch head 32, 34 the desired die is also always properly positioned beneath the punch at exactly the same time. During operation a workpiece 21 to be punched is moved into the proper position beneath one of the punching heads 32, 34 by sheet positioning system 50.

The bridge press frame 30 supports the linear tool holding cartridge 92, 94 and punch heads 32, 34. The two axis sheet positioning system 50 supports and positions a sheet metal workpiece 21. The press frame 30 and integral sheetmetal support table frame 50 define a three point support area and alignment of worksheet 21 relative to a selected punching tool is insured at all times, independent of the support floor. Punch press 20 therefore does not require a special foundation and this reduces installation time and cost, and simplifies relocation. The table carriage 52, which supports a cross slide 51 having sheet metal grippers 54, 56 mounted thereon, is of a bridge type construction permitting sheet loading from the side or front end of punch press 20.

A cartridge support cart 70, utilized with punch press 20, receives the punch and die linear cartridges 92, 94 from punch press 20 and permits offline tool changing. While the online cartridges are actively used in punching a worksheet, the offline cartridges can have their tools checked and replaced as required to be ready for the next lot of sheet metal panels to be punched. Setup time for the next set of sheet metal panels will then be short and consist of sliding out one set of cartridges 92, 94 and sliding in the already loaded second set of cartridges 92, 94. This concept increases machine uptime and productivity.

Figure 5:
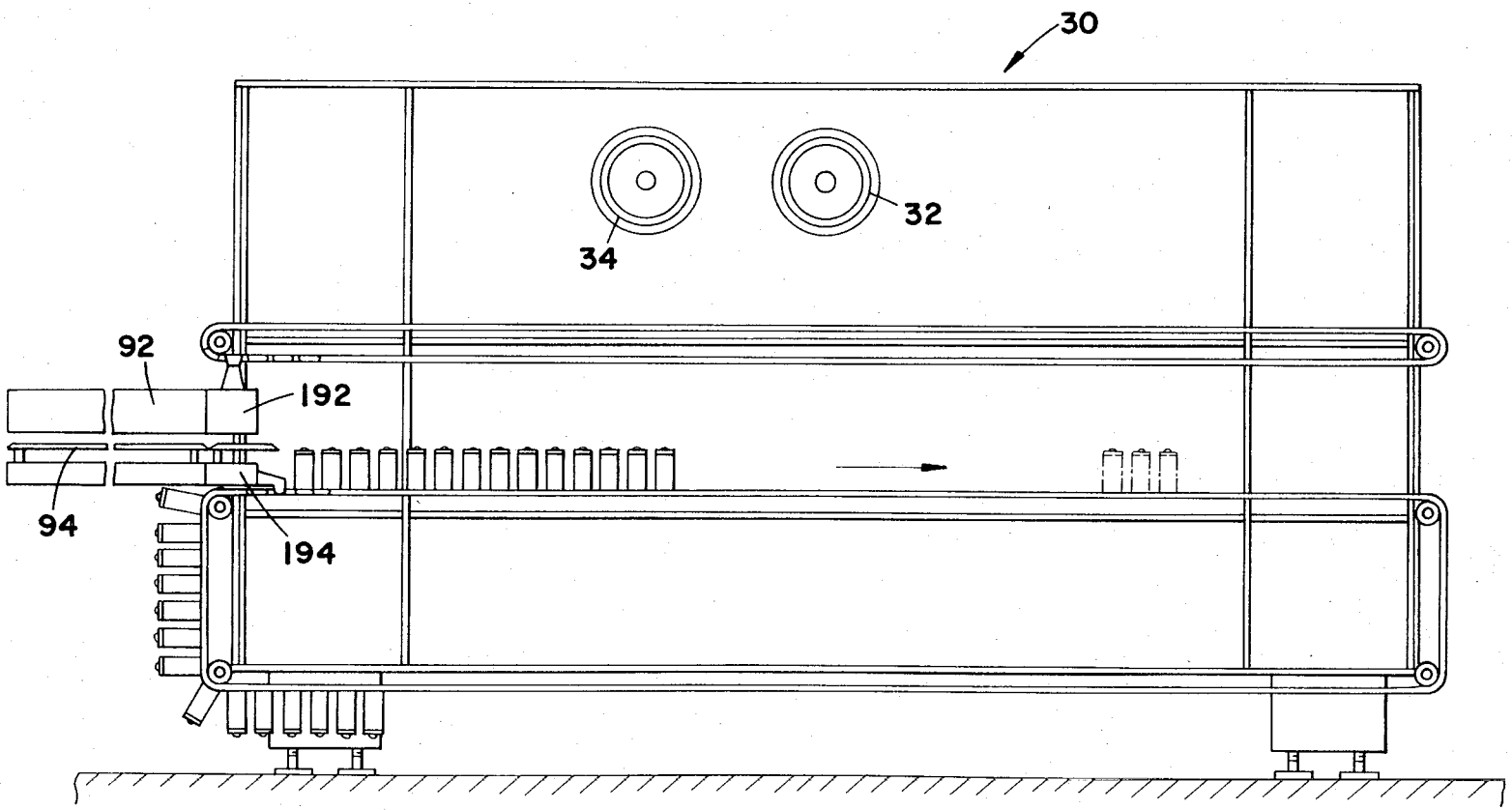
FIG. 5 is a section view through the punching assembly showing the disappearing table and elongated tool cartridges.
Figure 6:
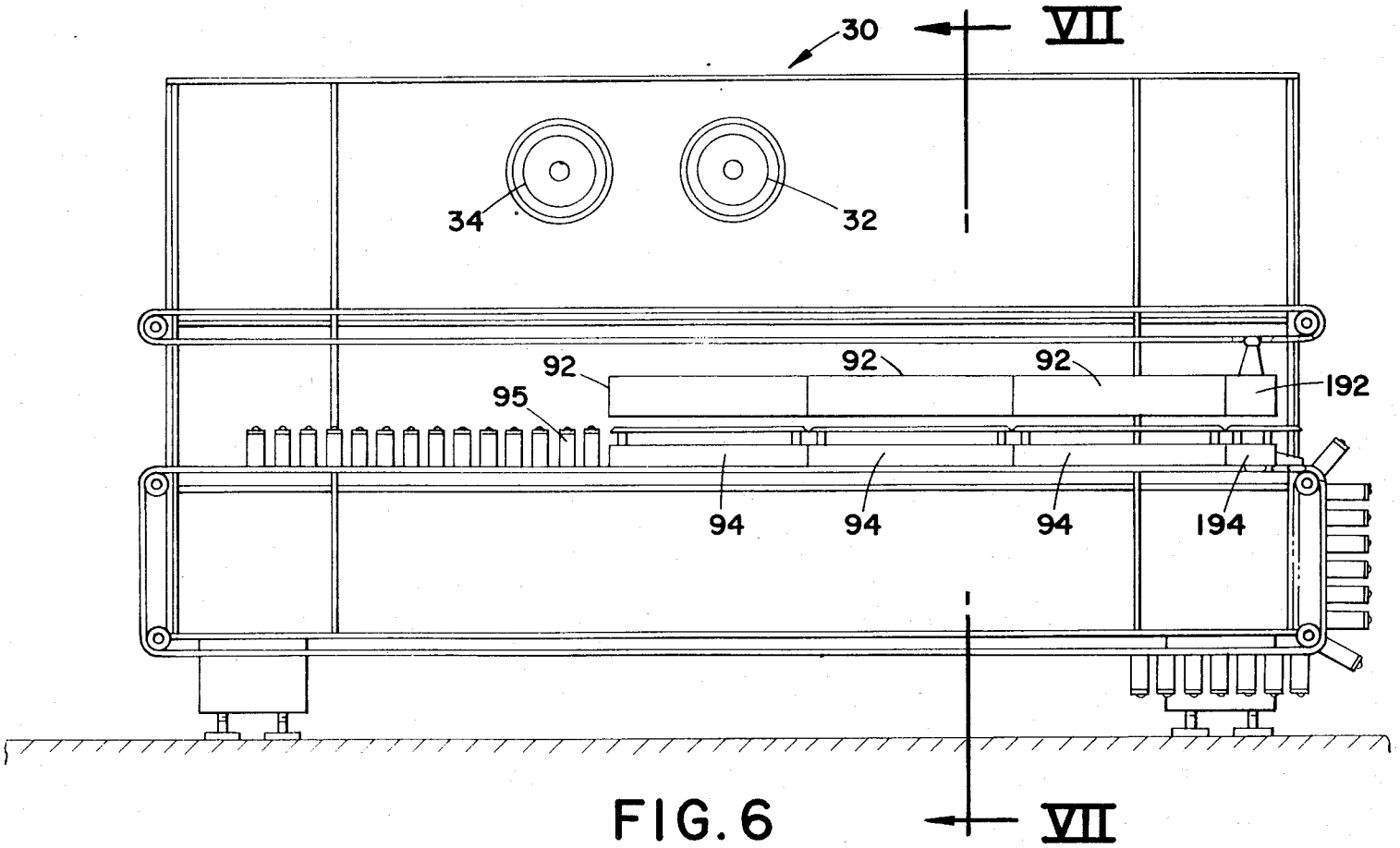
FIG. 6 is a view similar to FIG. 5 but with the cartridges moved to the right.
Figure 7:
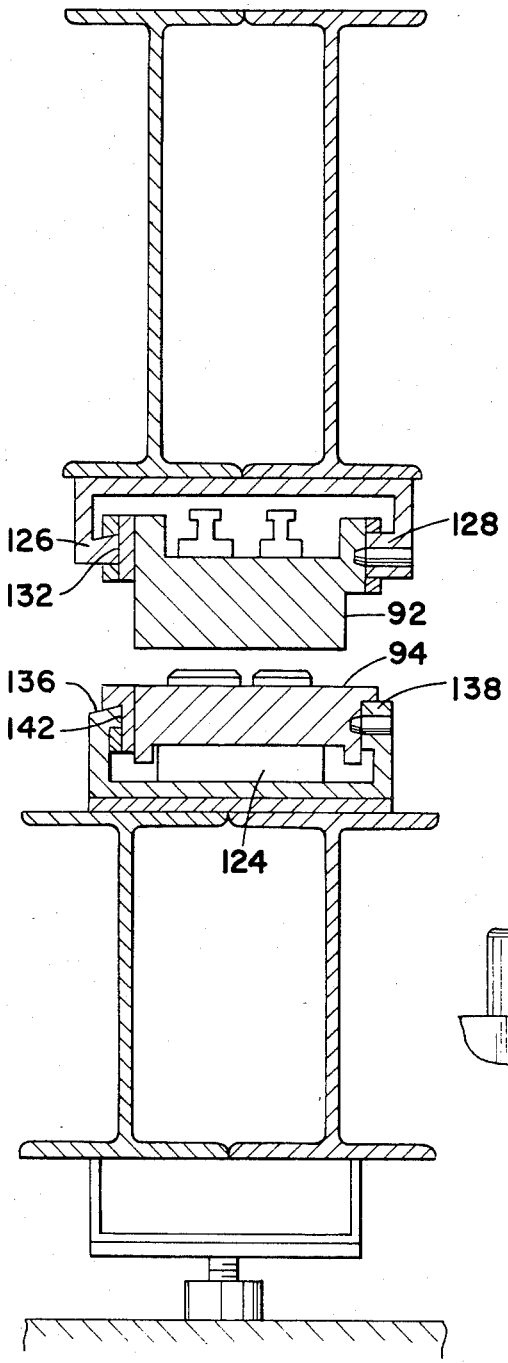
FIG. 7 is a section view taken of FIG. 6 along the line VII—VII thru a punch cartridge and a die cartridge.
Figure 9:
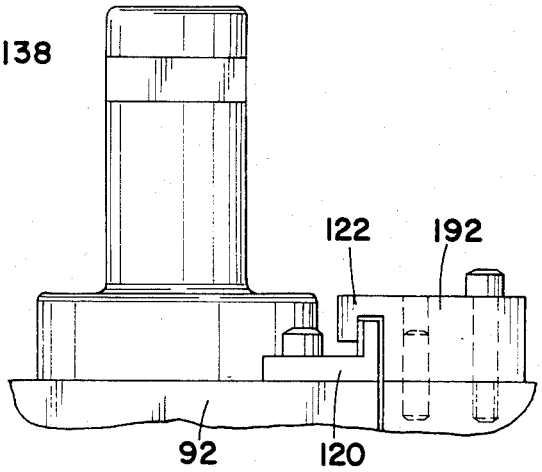
FIG. 9 is a section view taken of FIG. 8 along the line IX—IX showing the connection between the driver section and the tool cartridge.
Figure 8:
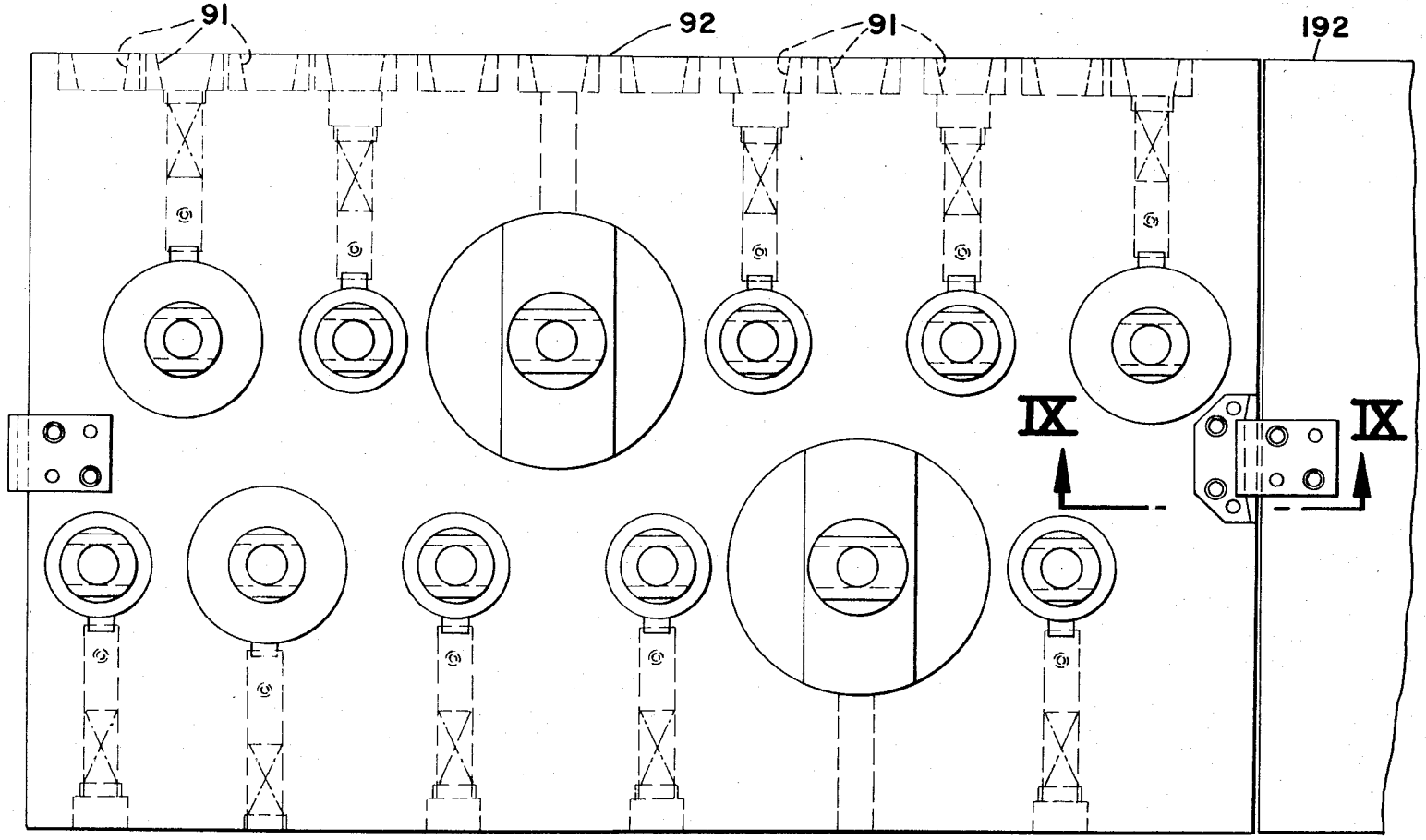
FIG. 8 is a top view of the upper punch cartridge showing a portion of the driver section and one tool cartridge.

Referring now to FIGS. 5 through 14 there is shown a linear cartridge tool system 90 utilized in punch press 20. Linear tool cartridge system 90 consists of punch cartridge sections 92 and die cartridge sections 94. Tool cartridges 92 and 94 are simultaneously moved into proper position so that when punching head 32, 34 engages a selected punching tool in cartridge 92 it is reciprocated through the worksheet 21 into an associated die supported by cartridge 94 beneath worksheet 21. As shown in FIGS. 5 and 6, driver sections 192 and 194, which can engage and position cartridges 92 and 94 respectively, are movable within the frame portion 30 of punch press 20. A plurality of cartrides 92 and 94 can be linked together to form a cartridge with the desired tool section. A disappearing table 95 is engaged by the last die cartridge 94 and is positioned following the last die cartridge 94 in frame 30.

Figure 23:
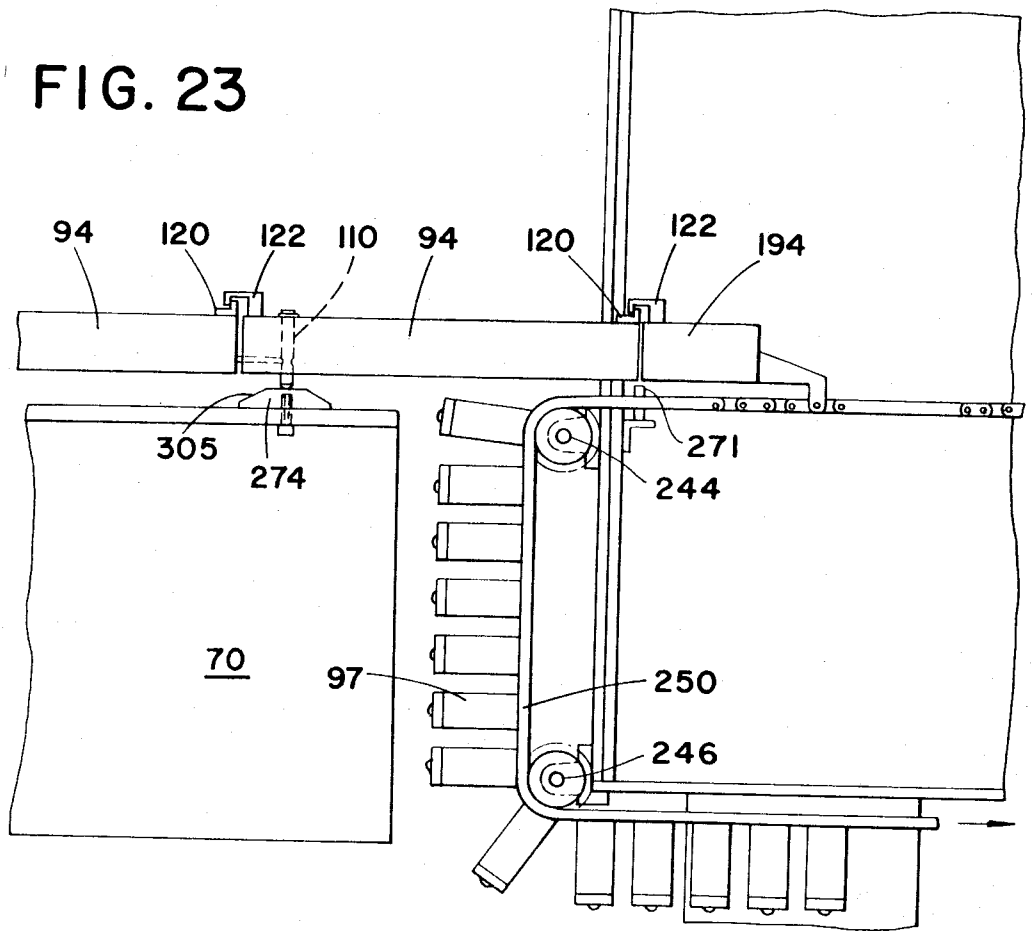
FIG. 23 is a diagramatic view of the disappearing table showing the automatic connection system.

As best shown in FIGS. 21, 22 and 23 a common drive motor 202 through an appropriate chain drive arrangement synchronously drives punch drive sprocket 210 and die drive sprocket 230. Sprockets 210 and 230 are attached to drive shafts 212 and 232 respectively. Attached to shafts 212 are sprockets 214 and 216 which drive chains 218 and 220. A driver block 192 is connected to drive chains 218 and 220 to be positioned as these chains are moved by drive motor 202. Driver block 192 attached to the dual drive chains 218 and 220 moves the upper punch cartridge 92 to position a desired tool under punch head 32, 34.

Drive motor 202 drives chain 203 which is connected to sprockets 210 and 230 for synchronous positioning of cartridges 92, 94. As drive motor 202 positions sprocket 230 the connected shaft 232 supports and positions sprockets 234, 236. Sprockets 234 and 236 drive a pair of mating chains 238 and 240 respectively. Driver block 194 is connected to and positioned by the pair of mating chains 238, 240. Connected to driver block 194 are die cartridges 94 which are positioned synchronously with their mating punch cartridges 92.

Figure 13:
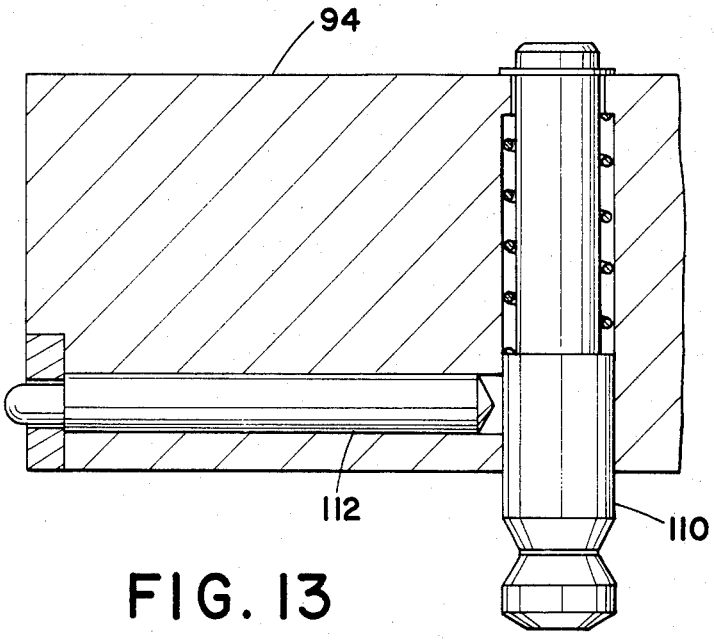
FIG. 13 is a section view along the line XIII—XIII of FIG. 11.
Figure 14:
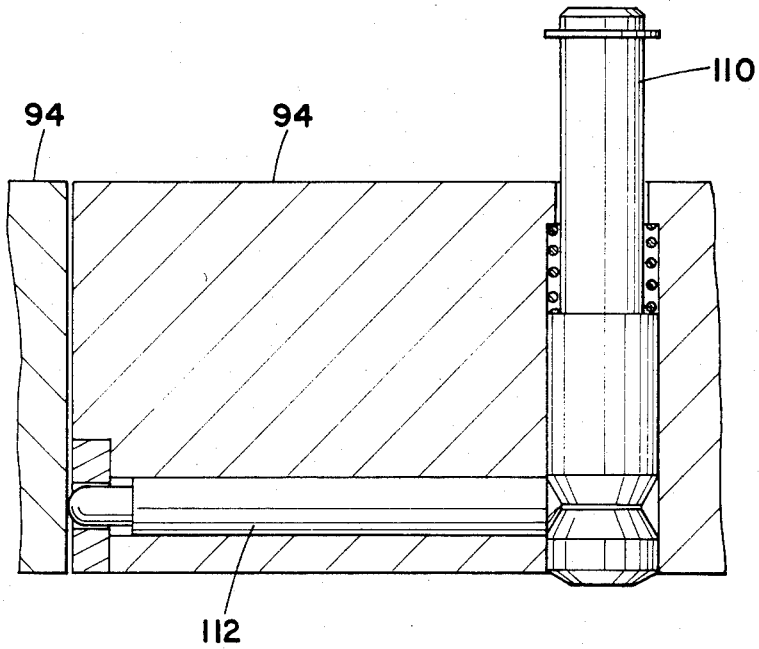
FIG. 14 is a view similar to FIG. 13 but with an additional cartridge in place.

In order to support the sheet during punching, as the cartridges move back and forth, a disappearing table 95 is provided. Disappearing table 95 consists of sections 97, which are positioned by the last cartridge 94, and sections 242, which are positioned with the driver block 194. As shown in FIGS. 13 and 14, when cartridges 94 are being connected together pin 110 is in a raised position and locking pin 112 moves into position to maintain pin 110 in a raised position. For the last cartridge 94 used however, pin 110 is not locked in an upward position. Pin 110 is spring biased to a down position and when not locked in an up position will, as the last cartridge 94 enters punch press frame 30, engage and move disappearing table sections 97. Disappearing table 95 will then fill in the area beneath the punching heads within frame 30 which is not occupied by cartridges 94. The disappearing table 95 is provided to provide support for the sheet metal workpiece next to the die cartridge 94. Two arrangements of disappearing tables are utilized. In one arrangement portions 242 of disappearing table 95 are attached to and positioned by the pair of mating chains 238, 240. The disappearing table 95 consists of a series of U-shaped support surfaces that are capable of disappearing from the horizontal plane and moving downward vertically as the cartridge 94 moves to the right. Each table link 242 is articulated from its connection to chains 238 and 240 to negotiate the 90 degree corner. As die cartridge 94 is moved back and forth disappearing tables sections 242 move into and out of the horizontal plane to provide support for the sheetmetal workpiece on one side of die cartridge sections 94. The pair of mating chains 238 and 240 extend around sprockets which are attached to shafts 244 and 246 and complete the loop at driver 194.

A different arrangement is provided for disappearing table sections 97 which are positioned and provide support at the rear of die cartridge 94. Disappearing tables sections 97 which are provided at the rear of cartridge 94 are attached to a second pair of mating chains 250 and 252. The second set of mating chains extend around idler sprockets 254, 256, 258, 260 which are supported by idler shafts 244, 246. Disappearing tables sections 97 follow automatically the last die cartridge sections 94 to be pulled into punch press 20. Idler sprockets 254, 256 and idler sprockets 258, 260 which support chains 250, 252 have bearing supports from shafts 244 and 246 respectively. Thus idler sprockets 254, 256, 258, 260 can turn independently of their supporting shafts 244, 246. These sprockets 254, 256, 258 and 260 which support chains 250 and 252 have ball bearing centers in order to turn freely on the respective support shafts 244, 246 and therefor do not necessarily turn and rotate when mating chains 238, 240 are positioned. Chains 250, 252 are attached to the vertical support pins 110 located in cartridge 94 by means of an anchor shaped hook 262 having two U-shaped portions. The hook 262 allows the engaged cartridge 94 to pull chains 250 and 252 and position the associated disappearing table sections 97. An air cylinder 270 positions an idler shaft 272 to maintain a constant pull on chains 250, 252 so that the hooks 262 firmly attach to pins 110 even when cartridge 94 moves in opposite direction. That is, cylinder 270 biases chains 250, 252 towards retracted position into engagement with pins 110.

An automatic connection system is provided for automatically engaging and positioning the drive chain 250, 252 for disappearing table sections 97. Since punch press 20 can be operated with one or more die cartridges it is important that the disappearing table sections 97 follow the last cartridge 94 section to be introduced into press frame 20 to support the worksheet 21 to be punched. The disclosed system requires no operator intervention or any special tool or fixtures to accommodate automatic connection of chains 250, 252 to the last die cartridge 94.

During operation as the die cartridge driver block 194 moves to project die cartridge 94 outside of the press frame 30 and onto the change station cart 70 the disappearing tables sections 97 move around the corner and descend vertically towards the lower chain level. When the disappearing table elements have totally left the horizontal upper position and have cleared a path for the cartridge to pass above them the hook 262 on each of the two chains 250 and 252 contact the stationary chain pins 271. The bias force to pull the chains 250, 252 downward to a retracted position provided by the air cylinder 270, acts as a constant spring force pulling hooks 262 into contact with pins 271.

Each hook 262 has two U-shaped portions. One of the U-shaped portions engage pin 110 when the disappearing table sections 97 are moved by cartridge 94. The other U-shaped portion engages pin 271 when cartridges 94 are moved out of punch press 20. The cartridge 94 when moved onto tool cart can be slid horizontally to disconnect locking elements 120 and 122. It should be noted that the tool cartridge 94 can be interchanged and replaced without the need for the operator to use any tools. Sliding cartridge 94 horizontally on cart 70 disconnects the joints. When a new cartridge has been slid into position and the control system for the press energized a punch driver block tows cartridge 94 back into the press frame. During this initial motion sections 97 of the disappearing table remains stationary since hook 262 remains in engagement with pin 271. If a following die cartridge 94 is in position, pin 110 is held in the up position as shown in FIG. 14. In this fashion as cartridge 94 is towed past hook 262 no connection will be made and the disappearing table sections 97 will remain in a stationary downward position. As the last cartridge 94 is pulled in, from the tool change stations on cart 70, pin 110 moves vertically downward as it is pulled off of cam surface 274. Pin 110 is then in position as shown in FIG. 13. As the end of the last cartridge 94, to go into the press frame, enters it engages hook 262 and moves the associated chains 250, 252. After this point motion of the cartridge entering the frame is followed by the disappearing table sections 97 as they are elevated up to the horizontal position. Disappearing table sections 97 are towed evenly by the two pins 110 which contact the hooks 262 that attaches the ends of chains 250, 252.

When cartridges 90 are moved to the offline position the tooling cartridges are moved outside of the main bridge press frame structure 30 onto a support tray structure 70. An upper support tray supports the punch holder offline cartridge 92 while a lower tray supports the die holder offline catridge 94. Once the cartridges 92, 94 are outside of the bridge frame 30 they may be separated by moving the offline cartridge sections 92, 94 towards the operator. As can best be seen in FIG. 9, separation of the offline cartridges 92, 94 from the online cartridges 92, 94 is accomplished by sliding the upward projecting member 120 from the downward projecting latch 122. Similar latching members are provided on both punch cartridge 92 and die cartridge 94.

Figure 24:
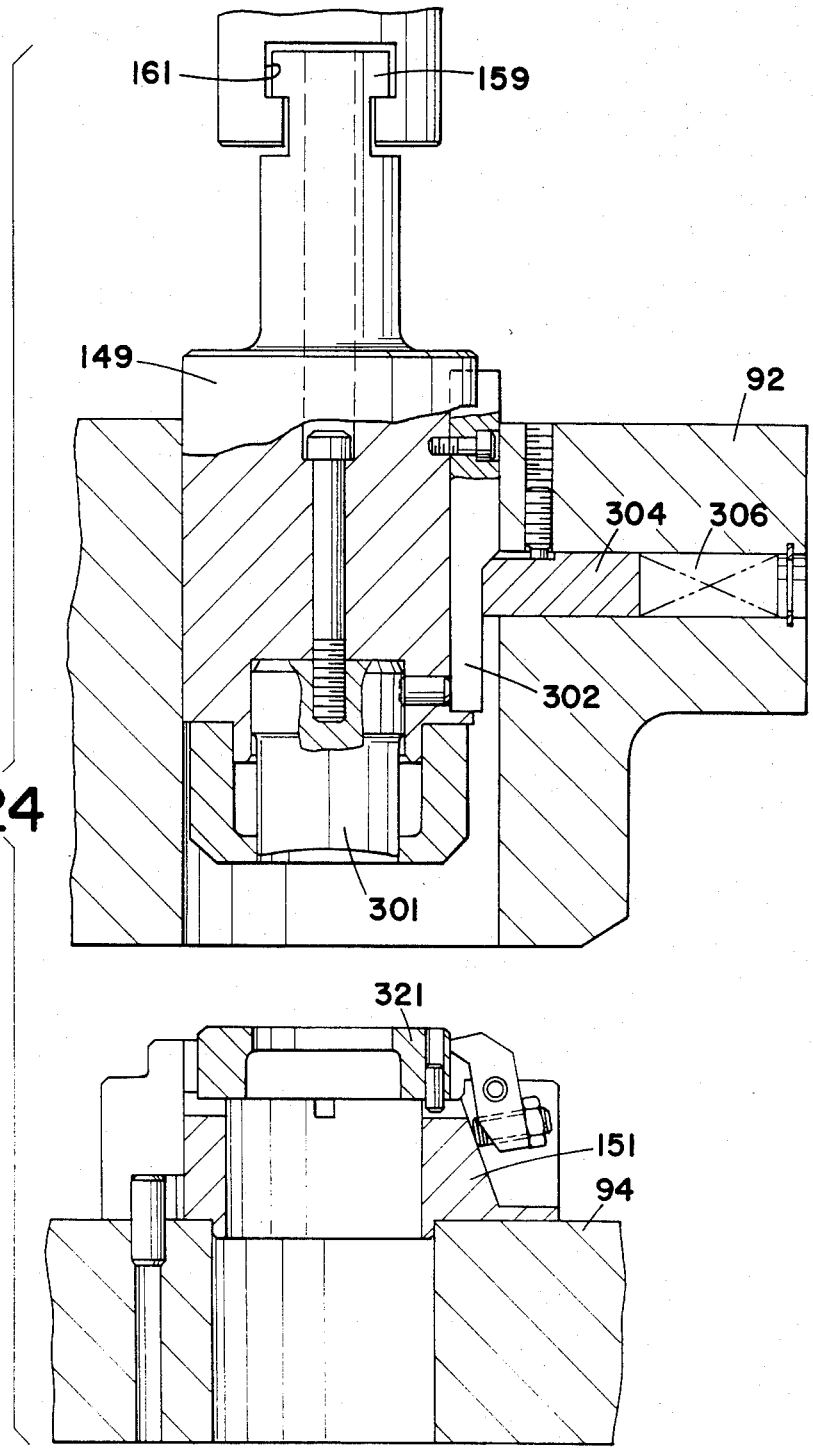
FIG. 24 is a cross section thru a punch holder and die holder.
Figure 25:
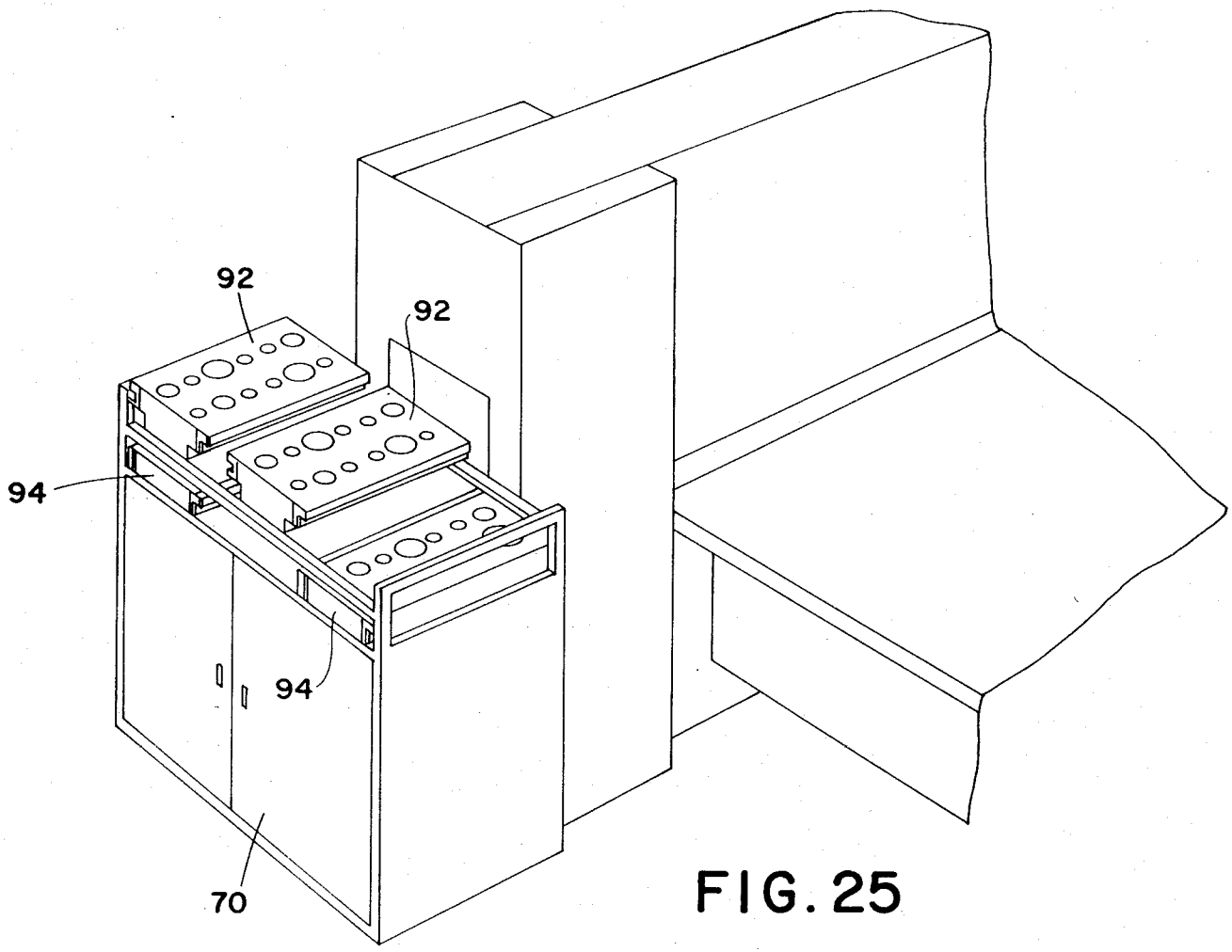
FIG. 25 is an isometric view of the tool changing station.

As shown in FIGS. 24 and 10, the upper tool cartridge 92 contains standard punch holders 149. The punch holder 149 contains the punch 301 and serves as the moving bearing surface against the punch cartridge 92 during punching periods. Index pin holes 91 are provided in line with each punch holder 149, which is supported in punch cartridge 92. Index pin holes 93 are provided in die cartridge 94 in line with each die holder 151. Cartridges 92 and 94 have a bearing surface for use in sliding the desired punch holder 149 and die holder 151 under the punch head 32, 34. To increase the tool density in the cartridges 92, 94 two parallel rows of tools have been used. The rows of tools are staggered along their longitudinal axes so that only one tool at a time is engaged by a punch head 32, 34. Normally several tool cartridges 92, 94 will be used. The tools in the first cartridge 92, 94 are the ones to be used on a wide variety of parts. These tools will be maintained online for most parts. In this fashion it is not necessary to have a duplicate set of these common tools in place. The offline cartridges 92, 94 contain various punches and dies that change from part to part. The number of tools in the cartridge 92, 94 which is maintained online most of the time versus the number of tools in the cartridges 92, 94 which are frequently offline can be varied to suit specific requirements. Cartridges 92, 94 can be configured to hold as many tools as desired by the user.

When twin punching heads 32 and 34 are utilized, any number, size and position of the tools in the second cartridge can be a repeat of the tools in the first cartridge. The two punching heads 32 and 34 are offset by the length of one cartridge. In this manner when the first cartridge positions a specific tool under the first punch head 32 an identical tool can also be positioned under the second punch head 34. Punch heads 32 and 34 operate in parallel thereby producing two identical parts or holes at the same time. The two punch heads 32, 34 can also be operated separately to produce similar parts at the same time. This can be accomplished when one panel needs one additional hole or one less hole by simply programming one punch head to run when the other does not. This operation creates similar panels while still enjoying the twin punch productivity benefits for the majority of common holes in both panels.

FIGS. 25 thru 30 illustrate cart 70 which is used for changing cartridges. Cart 70 provides support for three sets of tool cartridges. Cart 70 also includes a storage area beneath the support area for holding additional tools. In the top work area the cartridges can easily be manipulated for changing punches and dies. As a punch and die cartridge set 90 exit from the press onto the tool station each cartridge 92, 94 enters its own respective support tray. The punch and die support trays are equipped with a series of roller wheels which engage and support the cartridge 92, 94 as it leaves the press frame 30 and enters onto its associated tray. This provides for low friction and allows the cartridges to easily be inserted into the hat shaped section trays. When a punch and die cartridges set 90 have been fully pushed into position on the tool changing cart 70 the upper and lower trays may then be manually moved forward and backward in a direction perpendicular to their longitudinal axes. The upper and lower trays are equipped with roller wheels that mate with the top of the tool change station to allow the cartridges 92, 94 to be easily separated from one another. The separated cartridges can be replaced with other cartridges. These cartridges can be connected with other cartridges which remain in the press or with the driver blocks. The sliding disconnection of one set of cartridges from another is accomplished by the horizontal separation of the upward projecting member 120 from downward projecting latch 122. No tools are required by the operator to interchange cartridges at the tool change station.

Figure 26:
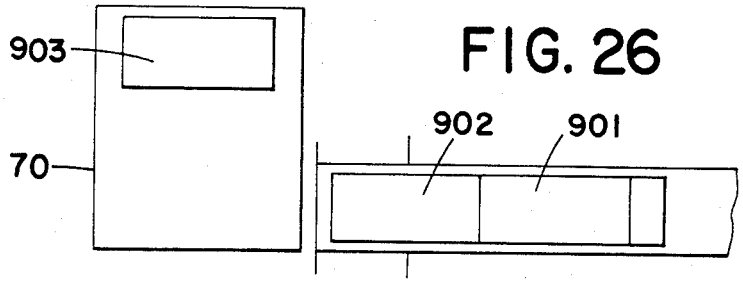
FIGS. 26 thru 30 illustrate cartridge changing operation in a three cartridge press.
Figure 27:
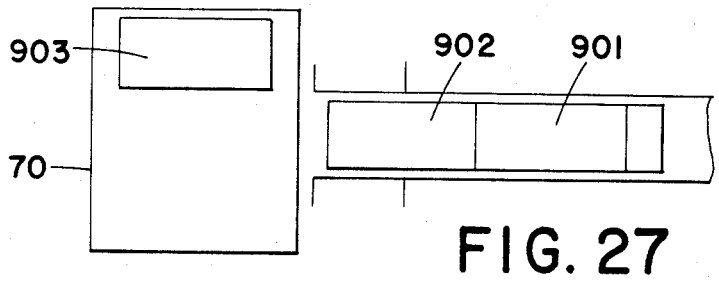
Figure 28:
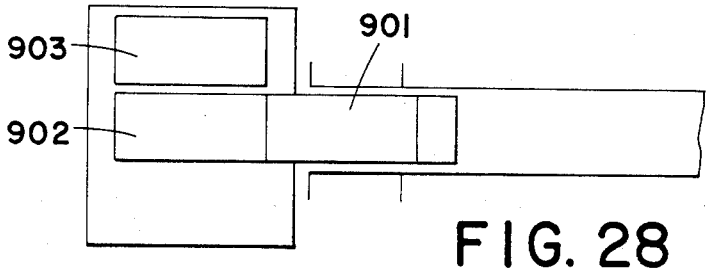
Figure 29:
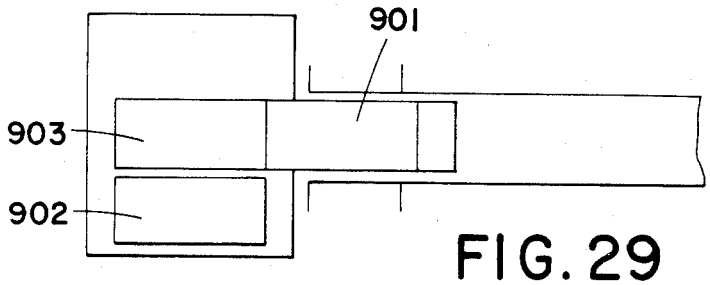
Figure 30:
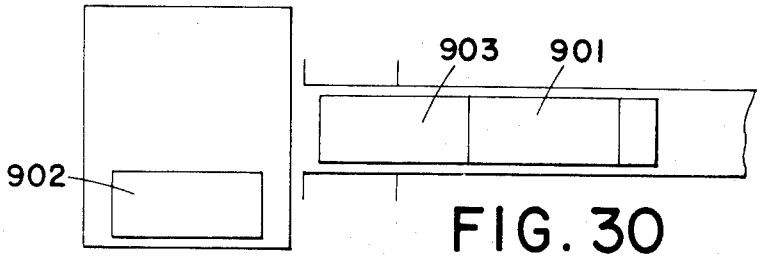

FIGS. 26 thru 30 illustrate a three cartridge system and a changing sequence. Cartridge set 901 contains standard tools that are used on all jobs. Cartridge set 902 is attached to cartridge set 901 and contains the special tools associated with a first job. Cartridge sets 901 and 902 then operate inside of press frame 30 to produce holes in the sheetmetal workpiece 21. Cartridge set 903 in the meantime is sitting offline at the tool change station 70 and is populated with tools to be used in the next job. The interchange of cartridge sets 902 and 903 is shown in sequence in FIGS. 27 thru 30. During changing cartridge set 902, as shown in FIG. 28, is moved onto the tool cartridge cart 70. Cartridge sets 902 and 903 are then manually slid in a direction horizontally perpendicular to the tool cartridge motion in the press, leaving cartridge set 903 connected to cartridge set 901. The servo system then pulls cartridge set 903 and 901 back into operation in the press. Before press 20 resumes operation tool change station 70 is moved backward to a position as shown in FIG. 26. Tool change station 70 rides on fixed rails and is moved back and forth between the positions shown in FIGS. 26 and 27 by a pneumatic cylinder.

FIGS. 5 and 6 illustrate the cartridge system installed in a bridge frame punch press structure 30. The bridge frame 30 provides excellent rigidity and support for the punching heads 32 and 34 and the tool cartridges 92 and 94. A cartridge tool changing window 98 is provided at one side of the press frame 30. This window 98 provides an opening to allow tool cartridges 92, 94 to be moved out of the press frame 30 onto tool cart 70.

FIG. 24 shows a vertical section elevation of a punch holder 149 in an upper cartridge 92 above a die holder 151 in a lower cartridge 94. Punch holder 149 is held in an upright or raised position in upper cartridge 92 by means of a cam 302 resting against a plunger pin 304. Plunger pin 304 is pressed tightly against cam surface 302 by spring 306. This mechanism will adequately retain the punch holder 149 in its raised position. When the punch holder 149 is inserted under the punch head ram the force of the ram pushes punch holder 149 downward and cam 302 pushes the plunger pin 304 back into its cavity thereby allowing the punch holder to proceed downward out of the upper cartridge 92. The punch 301 held by punch holder 149 can then mate with an appropriate die 321 through the intervening sheetmetal workpiece to produce the desired hole. The crank shaft and ram then move to a park position at top dead center. At the top dead center position plunger pin 304 has remated with the cam surface 302 and will hold the punch holders 149 in their upward position as they leave the mating T-shaped head area in the ram.

The punch cartridge 94 and die cartridge 92 feature a guideway bearing system consisting of a plastic type bearing material on the cartridge mating with the metalic way strips. Both punch cartridge 94 and die cartridge 92 are equipped with seal strips that mate with the way track to keep foreign debris out of the area of the bearing surface and distribute lubrication to the surfaces.

Cartridge 92 is supported by an angled way 126 and a flat way 128. During punching an index pin 87 engages an opening 91 in cartridge 92 and urges cartridge 92 against a vertical face 132 of slanted way 126. This index pin arrangement provides for accurate alignment of cartridge 92. The lower die cartridge 94 also is guided on an angled way 136 and a flat way surface 138. During the punching operation an index pin 87 engages an opening 93 in cartridge 94 and urges it into high accuracy contact with a vertical face 142 of guideway 136. The lower cartridge 94 is supported by a bolster plate 124 during punching, thus preventing punching loads from being applied to the bearing guideway system.

Figure 17:
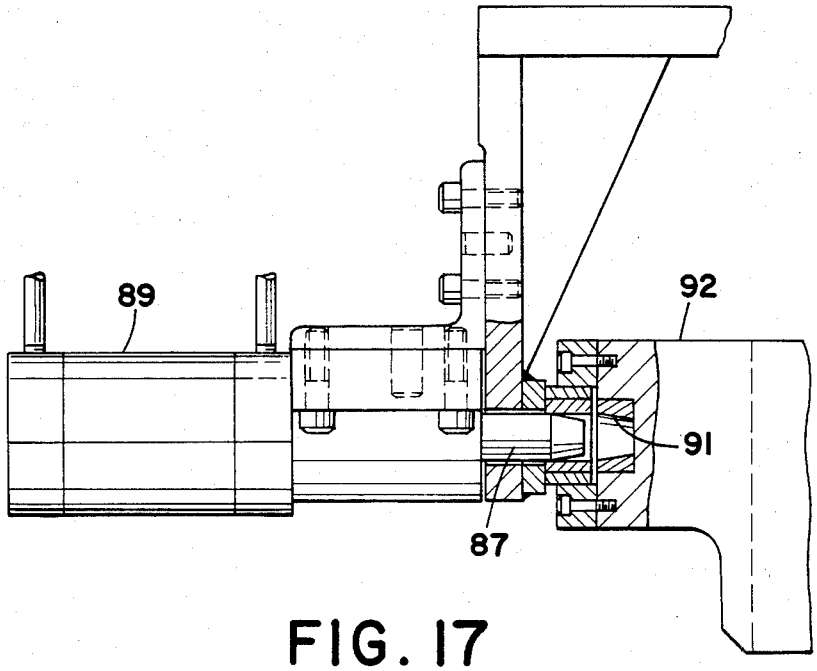
FIG. 17 is a detailed view of the indexing pin.

Referring now to FIG. 17 there is shown a more detailed view of the indexing pin mechanism. When cartridge 92 is positioned with the desired punching tool beneath punching head 32, 34 index pin 87 is driven by an appropriate drive mechanism 89 into indexing hole 91. Driving indexing pin 87 into hole 91 accurately aligns punch cartridge 92 longitudinally and moves it back against vertical surface 132 of the slanted guideway 126. This provides for high accuracy alignment of the selected tool in cartridge 92. A similar mechanism is provided for aligning the mating die in die cartridge 94. Thus, accurate alignment of the punch and die during operation is assured. When twin punching heads 32, 34 are provided two sets of index pins are utilized. At each punch head location there is an index pin for the upper cartridge and one for the lower cartridge for a total of four index pins.

Figure 19:
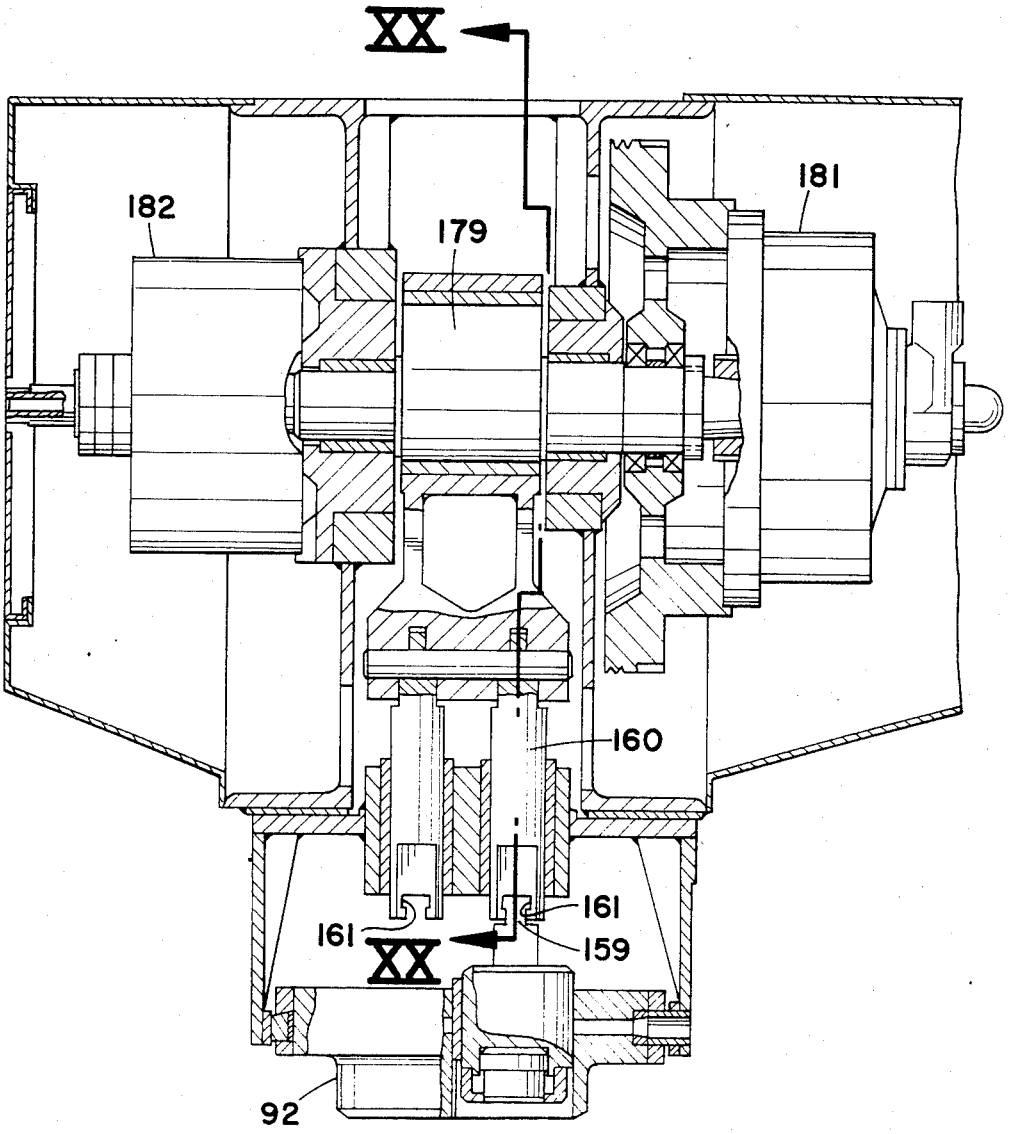
FIG. 19 is a view of the punch head assembly with portions deleted or broken away for clarity.
Figure 20:
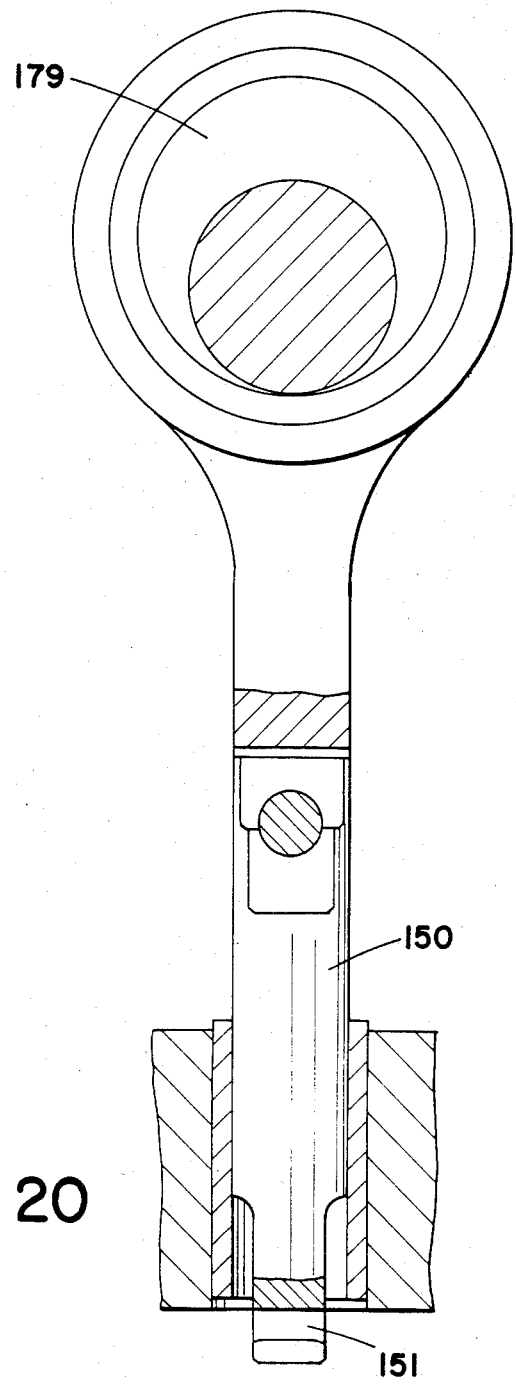
FIG. 20 is a view taken in FIG. 19 along the line XX—XX.

In order for one of the punch heads 32, 34 to select and operate one of the two rows of tooling in punch cartridges 92 an interposer mechanism is required. As can be seen in FIGS. 19 and 20, the T-shaped punch head 159 fits within a T-shaped slot 161 in an interposer 160. Two interposers are provided to line up with the front and rear rows of punch tools in the cartridge 92. As described above, the tools in the cartridge 92 are located in a staggered pitch configuration such that when the specific punching tool is brought in line with the two interposers only one of the T-shaped slots 161 engages a punching tool. In this fashion the cartridge can be brought onto an interposer centerline and the punching head 32, 34 operated to stroke the interposer 160 and the aligned punching tool in a vertical plane. The other interposer 160 and T-slot 161 is located between punching tool positions of the alternate row of tools and therefore does not actuate a punch in that row. The two-row tooling cartridge greatly enhances the packing density of tools within the cartridge 92, 94. More than two rows is possible.

Many parts processed on punch presses are of the type where multiple identical parts are grouped onto a common larger sheet. With the disclosed punch press 20 significant productivity increases can be obtained by incorporating two identical punch head mechanisms 32, 34 that interact with identical tooling in the tooling cartridge system 90. Each cartridge system 90 consists of a punch cartridge 92 and a die cartridge 94. In the preferred embodiment each system 90 contains twelve punches and dies. The punches and dies used in the cartridge system are identical to those used in some prior art punching machines. In the present preferred embodiment in the cartridges 92, 94 are 24" long. It is to be understood however, that different length cartridges could also be used. The spacing between twin punch head mechanisms 32, 34 is also designed to be 24". The second tool cartridge set 90 can be loaded to contain identical tool size and spacing patterns as the first tool cartridge set 90. For twin punching the two sets of cartridge sets 90 containing common tools are loaded into the cartridge system. A common sheet metal panel can then be loaded onto the table 51 and processed by means of actuating both punch heads at the same time while the sheet is stationary at each of its desired X-Y coordinates. The result is simultaneous punching of two identical parts and the throughput of the machine is virtually doubled.

Figure 16:
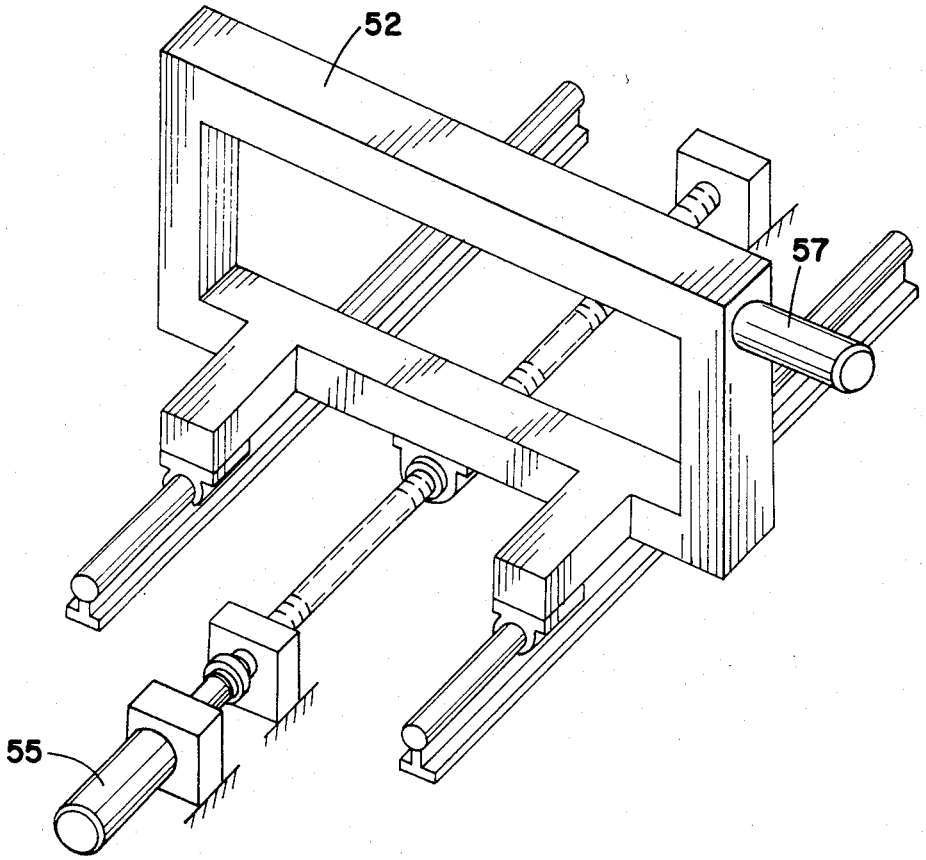
FIG. 16 is a view showing the Y-axis carriage drive.

Carriage 52 spans and extends around the sides of workpiece support table 53. Table 53 includes a plurality of spherical roller support members which permit low friction movement of work sheet 21. As shown on FIG. 16 carriage 52 is constructed to extend around work table 53 and engages a ball screw positioning mechanism. As servo motor 55 is driven, through an appropriate ball screw arrangement, carriage 52 moves a workpiece to the desired Y-axis location. Servo drive motor 55 rotates a supported ball screw which is engaged by a ball screw nut attached to an underportion of carriage 52. Carriage 52 rides on linear ways and supports.

Figure 15:
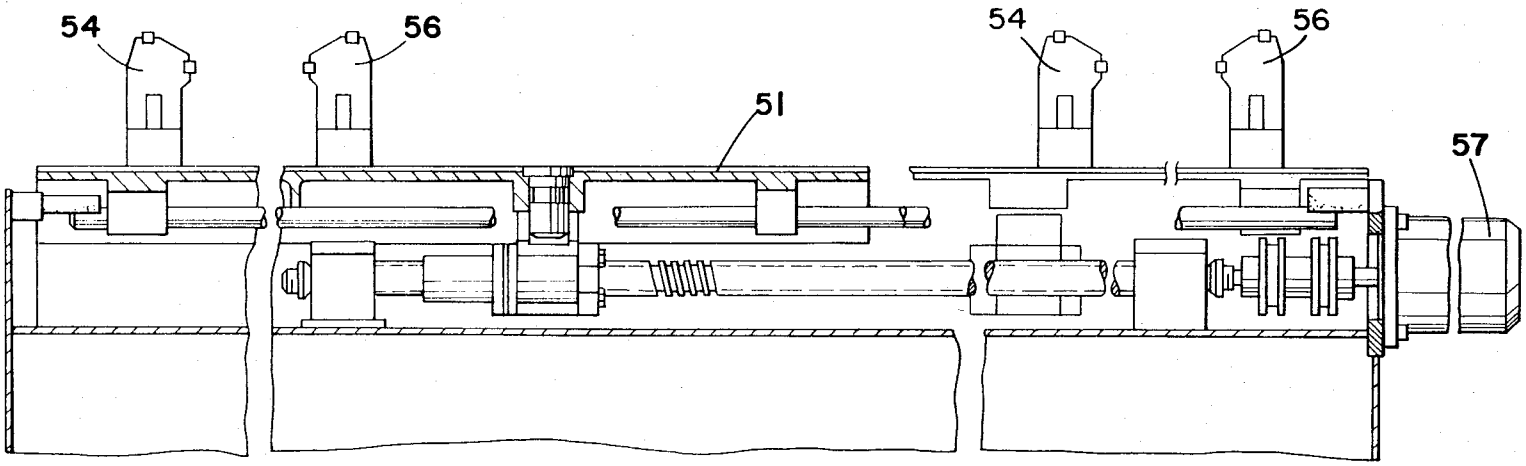
FIG. 15 is a view showing the X-axis cross slide.

Referring now to FIG. 15 there is shown a partial section view of the cross slide which provides for X-axis positioning of the workpiece. Servo drive motor 57 drives a ball screw arrangement which positions cross slide 51 along the X-axes. Sheet grippers 54 and 56 are retained in T-slot formed in cross slide member 51. Sheet grippers 54 and 56 are relatively positionable on cross slide 51 and they can grip the end or sides of a work sheet 21. Grippers 54 and 56 are supported by member 51 which is movable across carriage 52 to provide for X-axis positioning of the gripped worksheet 21.

Figure 2:
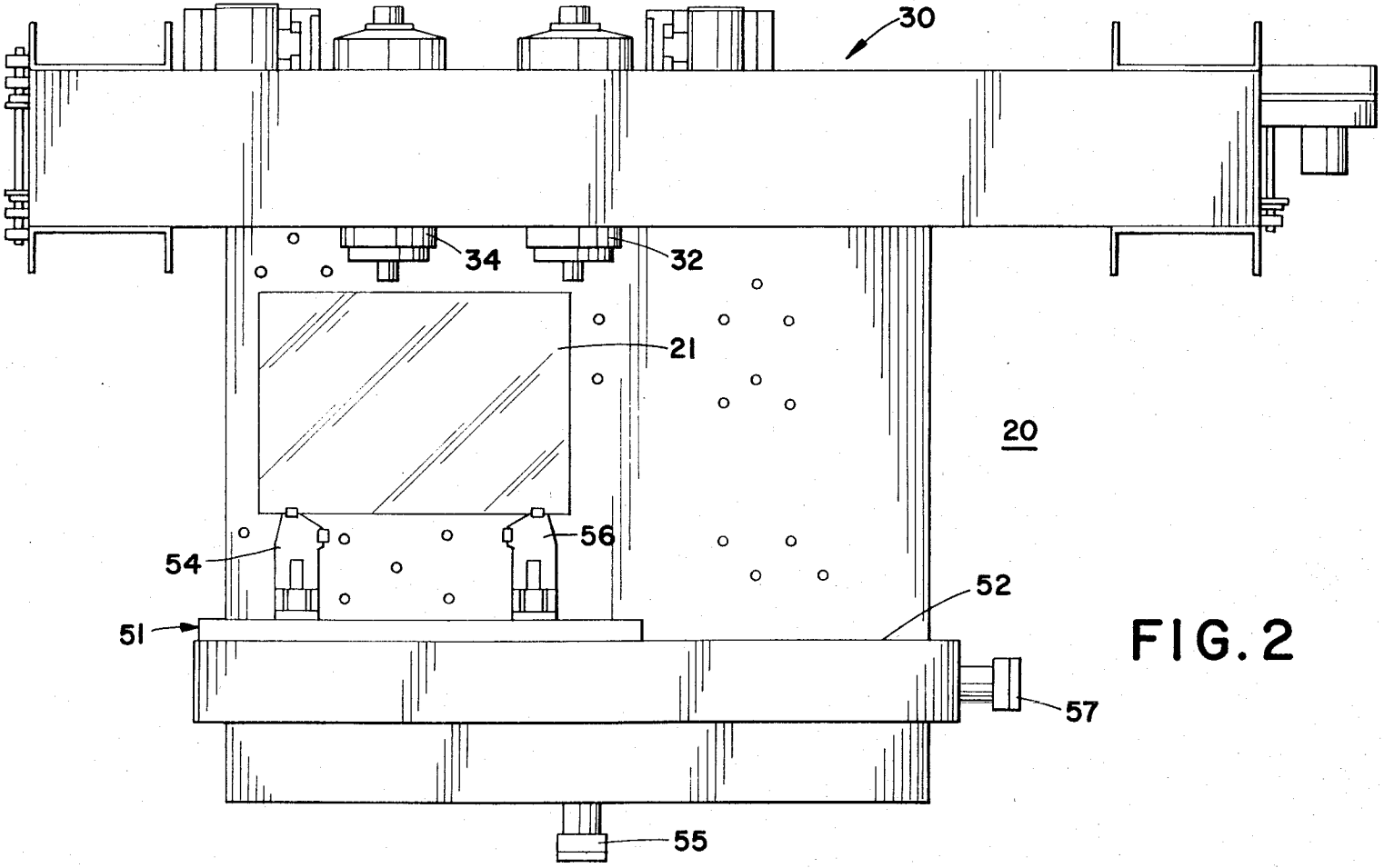
FIG. 2 is a top view of the punch press shown in FIG. 1.
Figure 3:
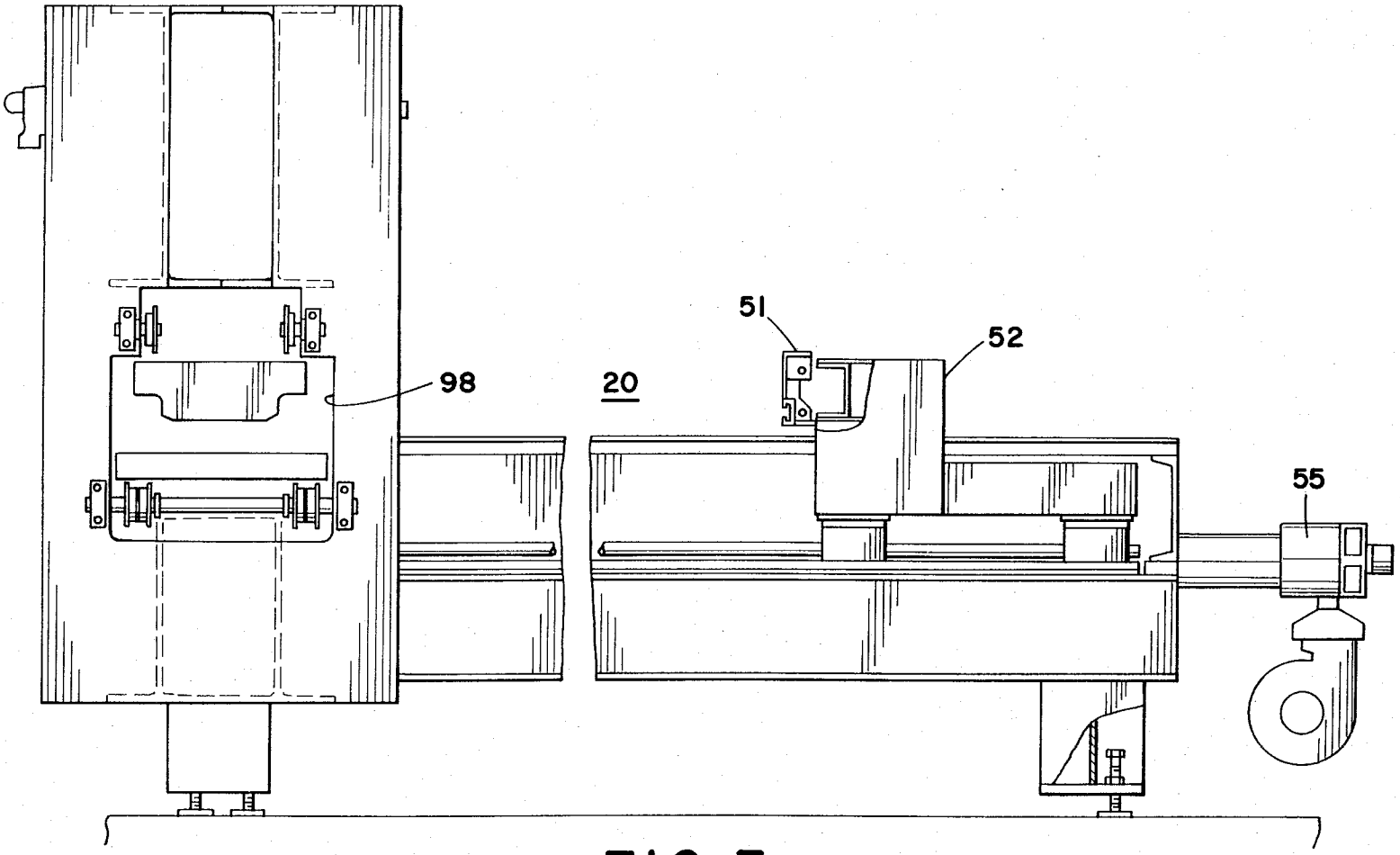
FIG. 3 is a left side view of the punch press shown in FIG. 1.

When utilizing a worksheet gripping system which can be loaded from the end or the side it is necessary to have workholders 54, 56 that are capable of gripping the end of the sheet, as is standard fashion, or the sides of the sheet. One configuration of an acceptable workholder is illustrated in FIG. 2. Copending U.S. patent application Ser. No. 401,446 entitled Universal Sheet Metal Holder whose teachings are herein incorporated by reference, illustrates and describes in detail a preferred universal worksheet holder.

Figure 18:
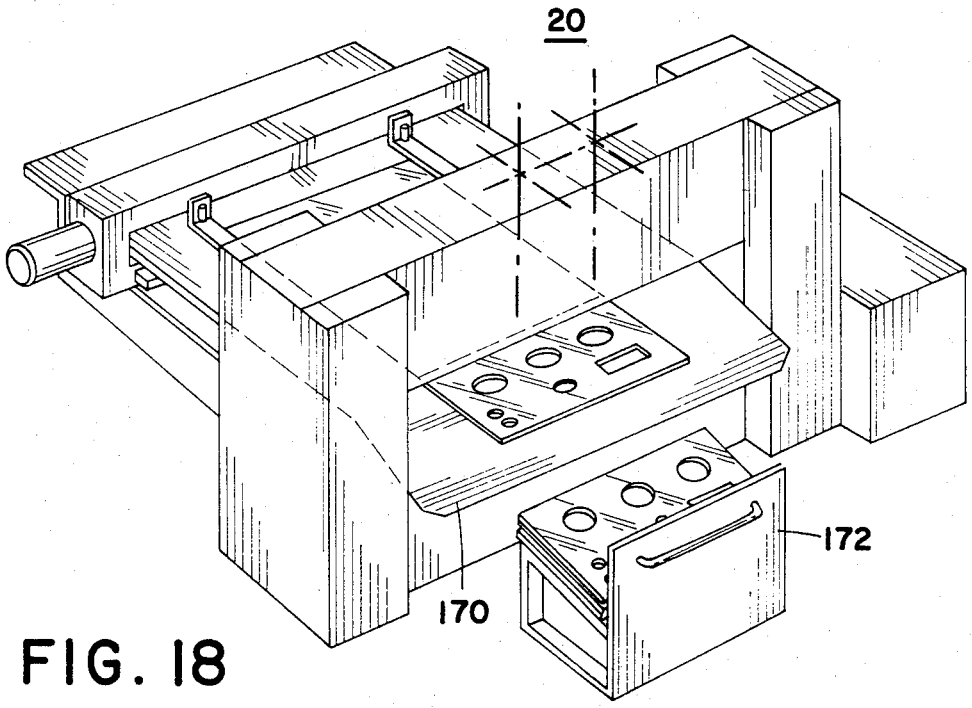
FIG. 18 is an isometric view from the back of the press showing a tilting unload table.

FIG. 18 illustrates an automatic unloading feature. By utilizing a linear tool cartridge concept, finished small size sheet metal parts can be separated from the parent material by means of a blade tool with the resulting part extending through the punch press 20 and not being trapped between turrets. The finished parts can be supported on a tiltable unload table 170. During operation the finished parts can be cut free from the parent material and the unload table 170 tilted to allow the part to slide off onto a stack on a receiving cart 172. This concept can also work with individual parts where upon completion of punching the workholders 54, 56 would be released and the table 170 tilted to allow the part to slide off onto an unload stack. This construction increases the system throughput by elimination of the manual unload cycle and also reduces loading time by allowing the carriage 52 and workholders 54, 56 to return to the load position in parallel with the unload function and come to rest with the workholders 54, 56 open ready to receive the next part.

The size of part that can be cut free by a blade tool is limited to one where the part itself due to its size and mass may become unstable and move as its retaining piece of metal to the main panel becomes smaller and smaller as it is cut off. The twin punch construction eliminates this problem by doing the cutoff action on approximately 24" centers thereby always leaving a widely spaced two tab connection to the panel until the finished cutoff stroke when the two punches in parallel sever the finished part from the parent panel. The bridge frame 30 is an I-beam structure that offers structural strength and rigidity in the vertical and horizontal planes. This rigidity provides more support for the tooling and will result in better punch and die alignment during all phases of punching, forming, and nibbling. This increased rigidity will in turn improve tool life. The locking indexing pins 87 are mounted in close proximity to the punch and die stations and this aids in alignment. Supporting the integral bridge frame and table assembly on three mounting pad areas reduces stresses in the machine due to uneven and settling floors. Shock absorbing pads are inserted underneath the mounting pads, without disturbing the sheet to punch alignment, to further reduce dynamic floor loading. This three support area construction and shock pads eliminates the need for special foundations and press 20 can rest on a standard concrete shop floor.

Punch press 20 also includes an improved clutch-brake slider crank punch head 32 or 34. Punch head 32, 34 includes a crankshaft 179 which is driven by an electric motor through a clutch 181. A brake 182 is utilized for stopping crankshaft 179 at the top dead center position. A more complete description of the improved punching head is given in copending U.S. application Ser. No. 401,445, entitled Punch Head for a Punch Press whose teachings are herein incorporated by reference. Each time a punch head 32, 34 completes a punch cycle the brake 182 dissipates a fixed amount of energy as heat in stopping crankshaft 179 rotation. When the punch head 32, 34 is operated at its maximum punching rate the heat load on the brake 182 and the brake lining temperatures are at a peak. High brake lining temperatures affect braking friction and cause variations to occur in the crankshaft 179 stopping position. In the disclosed punch press 20 the crankshaft r.p.m. speed is reduced to lighten the heat load on the brake 182. This is very effective since the energy absorbed by brake 182 is a function of the square of the crankshaft 179 rotational speed. Axial brake air flow is also utilized and this provides superior cooling. To offset the lower r.p.m. and to further improve the punching rate, the crankshaft 179 eccentricity is increased significantly. By doing this, a much smaller portion of the crankshaft 179 revolution is utilized when punching. In the disclosed punch press 20 the punch is exposed from cartridge 92 for less than 183 degrees of crankshaft rotation. Thus, only a portion of the crankshaft revolution cycle is in series with the table move time; the remainder of the crankshaft revolution is in parallel with table move time allowing a higher punch rate. The overall result of the reduced crankshaft r.p.m. and the increased crankshaft eccentricity is that while the system operates at a lower crank r.p.m. a higher punching rate can be achieved. This construction permits continuous stroke nibbling and thus eliminates a major source of heat generation.

Continuous stroke nibbling can be achieved by engaging the clutch 181 for the first punching stroke and then leaving it engaged until the last punch stroke has been performed. The clutch 181 is then disengaged and brake 182 applied in the same fashion as during intermittent punching. Each 360 degree revolution of punch head crankshaft 179 movement is divided into two segments, punching cycle and work sheet advance cycle. In order to insure that the worksheet 21 is not in motion during the punching cycle, the carriage 52 is not allowed to advance until the punch is safely retracted up inside the upper cartridge 92. This assures that the punch has been stripped from the sheet even if the stripper has not performed its task. The carriage 52 is then advanced to the next position before the punch reaches the top surface of the workpiece to be punched. To have sufficient time to advance the sheet 21 between punch cycles, it is desirable to have a larger percentage of each crankshaft revolution associated with table movement. The disclosed press 20 with its increased eccentricity crankshaft 179 allows more than 177 degrees of rotation for table movement. This coupled with the lower r.p.m. provides for adequate sheet movement during continuous stroke nibbling. Even higher hits per minute can be achieved by allowing the carriage 52 to advance as soon as the punch stripper has lifted on the top surface of worksheet 21.

Referring to FIG. 10 there is shown a pair of cartridges 92 and 94 and a pair of aligning pins 21 and 23 which can be used for offline tool cartridge alignment. In order to allow the operator to check the alignment between a new punch and die added to the cartridge system 90 and two precision pins 21 and 23 can be inserted to couple the upper cartridge 92 to the lower cartridge 94 in precise alignment. When this is done the operator can manually push the punch holder 149 assembly down compressing the punch holder support spring 306 and moving pin 304 to allow the punch to enter into the die to verify proper alignment and the proper tool is in place. In most prior applications tool alignment is normally done at the punching station where the tools are brought into position. They are then locked in position and the crankshaft is manually rotated with a hand tool to verify that the proper punch enters the die. This time consuming operation reduces productivity. Prechecking of the alignment of the punch and dies in the offline tool cart 70 will enhance throughput of the system.

An additional feature of the twin punch system is that it will allow sheets wider than the normal capacity of the press to be punched. For example, referring to the 24" distance between the two punch heads, it is possible to punch a sheet 24" wider than normal capacity by first punching normal width capability across the sheet and then removing the sheet and turning it around 180 degrees or turning the sheet over to expose the unpunched side to the second punch head. The sheet would then have the remaining unpunched areas punched by the second punch head. Using this technique allows one less cartridge worth of tools to be utilized on the sheet since all three cartridges cannot be brought under both punch heads for use on the machine. However, if the operator can put a suitable number of tools in the two cartridges to perform the desired punching operation, this feature is very powerful since it adds the equivalent of 24" additional width capacity to the machine.

Figure 4:
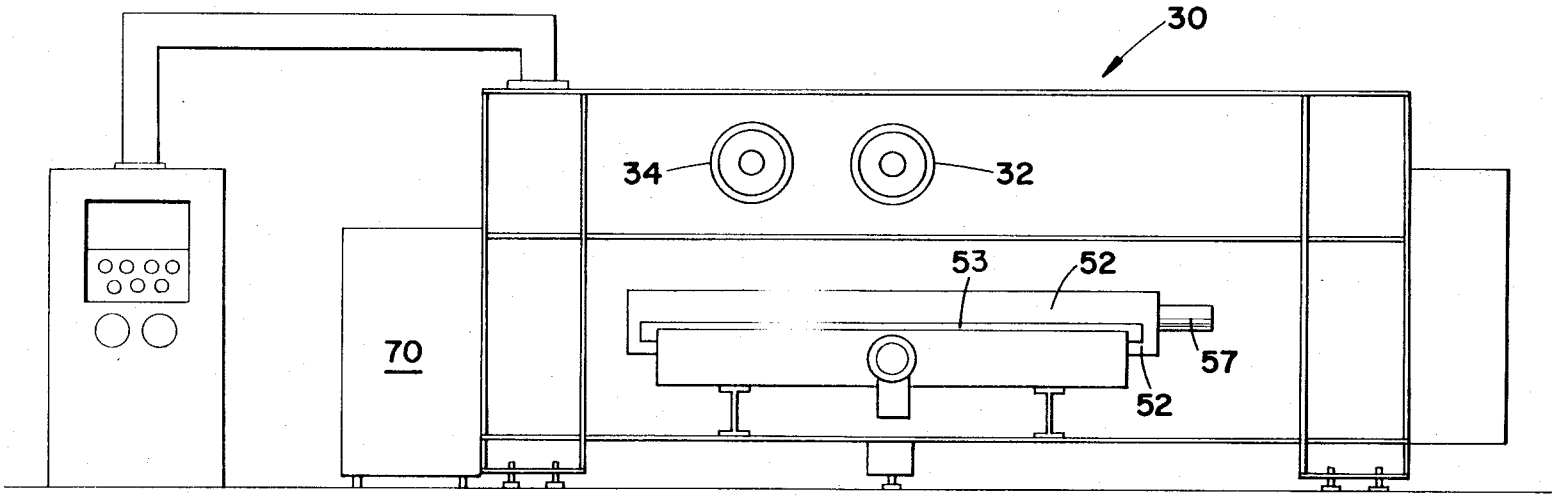
FIG. 4 is a front view of the punch press shown in FIG. 1.

A controller 18, as shown in FIG. 4, is provided for controlling operation of punch press 20. Controller 18 is a three axes Computer Numerical Control (CNC). The X-Y table positioning axes and the positioning of the tool cartridge are of a closed loop servo design. This ensures that machine drives are at the prescribed positions prior to punching. The controller maintains on all three axes the proper acceleration and velocity profiles and limits as well as controls the axes positioning.

Controller 18 also controls all other major machine functions such as the punching heads 32, 34, the workholders 54, 56 the worksheet positioning system, the lubrication system, the worksheet load-unload system, the slug removal system and various other automatic functions which might be used on punch press 20. The controller 18 continuously monitors all important machine functions and parameters. It automatically diagnoses operating errors and/or out of limit conditions. Controller 18 then disables affected functions and displays the appropriate error message on the visual readout. Controller 18 is designed to operate on piece part data supplied from paper-tape, the operator's panel keyboard or a remote source such as another computer via a built in communication path.

We claim:

1. A punch press (20) having a frame which spans a punching area, a punch head (32) supported on said frame (30) above the punch area, a two axis worksheet positioning mechanism (50) for positioning a sheet metal workpiece at desired locations in the punching area, characterized by:

an elongated punch support formed from removable punch cartridges (92) joined together and positionable as a unit to bring a selected punch beneath the punch head, with each punch cartridge (92) supporting a plurality of punches; and, an elongated die support formed from removable die cartridges (94), corresponding to said punch cartridges (92), joined together and positionable as a unit simultaneous with positioning of said elongated punch support to position an appropriate die to receive the selected punch, with each die cartridge (94) supporting a plurality of dies.

2. A punch press (20) as claimed in claim 1 characterized by:

a second punch head (34) supported on said frame (30) above the punching area and separated from said punch head (32) by the length of a cartridge (92), (94).

3. A punch press (20) as claimed in claim 1 characterized by:

a punch driver section (192) disposed in said punch press (20) for engaging and positioning a punch cartridge (92), a die driver section (194) disposed in said punch press for engaging and positioning a die cartridge (94).

4. A punch press (20) as claimed in claim 1 characterized by:

a disappearing table which is engaged and positioned by the last removable die cartridge (94) forming said elongated die support.

5. A punch press (20) as claimed in claim 1 characterized by:

at least two rows of longitudinally aligned punches supported in each punch cartridge (92).

6. A punch press (20) as claimed in claim 5 characterized by:

a plurality of openings (91) formed on one side of each punch cartridge section, each opening associated with one of the punches in each row of said at least two rows of longitudinally aligned punches;

a punch index pin (87) movable into engagement with the opening which corresponds to the punch to be activated for accurate alignment during punching;

a plurality of openings (93) formed on one side of each die section, each opening associated with a die to be aligned with its associated punch; and, a die index pin (87) movable into engagement with the proper opening for accurate alignment of the die section during punching.

7. A punch press for acting on a worksheet comprising:

a main frame defining an elongated opening extending therethrough and being supported from only two areas;

a table frame securely attached to the front of the main frame and having only a single area support spaced apart from the connection to said main frame to define in conjunction with said main frame only a three-area support system;

a punch head mechanism supported from said main frame including a ram which can be reciprocated;

a work table supported on said table frame for supporting the portion of the worksheet in front of said main frame;

X-Y axes sheet positioning means disposed for two-axis positioning of the worksheet on said work table;

a plurality of punches positionable with respect to said main frame;

punch support means for supporting said plurality of punches from said main frame;

a plurality of dies associated with said plurality of punches positionable with respect to said main frame;

die support means for supporting said pulanty of dies from said main frame; and, connecting means for connecting the ram of said punch head to a selected punch which in cooperation with the associated die acts on the worksheet when the punch head ram reciprocates.

8. A punch press as claimed in claim 7 wherein said X-Y axes positioning means comprises:

a carriage member extending above and across said work table, providing free access for positioning of a worksheet at any position on said worktable beneath said carriage, and said carriage movable in an Y-axis direction with respect to said work table;

a cross slide supported from and movable along said carriage in an X-axis direction; and, a pair of work sheet grippers supported from said carriage and movable with said cross slide in a X-axis direction.

9. A punch press as claimed in claim 8 wherein:

said sheet metal grippers can grip an end of a worksheet which extends past the front of the gripper and a side of a worksheet which extends past the side of the gripper.

10. A punch press as claimed in claim 7 comprising:

an unloading table disposed on said main frame on the side opposite said table frame; and, means for tilting said unloading table with respect to said main frame for automatically unloading pieces which are formed from the worksheet.

11. A punch press for acting on a worksheet to form parts comprising:

a frame formed from structural members defining an elongated opening into which the sheet workpiece can be positioned;

punch holding cartridge means for supporting a plurality of punches and being supported from and movable with respect to said frame;

die holding cartridge means for supporting a plurality of dies and being supported from and movable with respect to said frame;

a punch head mechanism supported from said frame having an interposer for engaging and reciprocating a punch to act on the worksheet;

positioning means for positioning said punch holding cartridge means and said die holding cartridge means to the desired position;

said punch holding cartridge means comprises a punch driver section and at least one detachable punch cartridge which is latchable to said punch driver section for unitary movement therewith; and, said die holding cartridge means comprises a die driver section and at least one detachable die cartridge which is latchable to said die driver section for unitary movement therewith.

12. A punch press as claimed in claim 11 comprising:

a work support table, defining a work table plane, connected to said frame for supporting the worksheet;

a worksheet positioning means disposed for two-axes positioning of the worksheet on said work support table; and, a disappearing work support table section attached to an movable with positioning of said die holding cartridge means.

13. A punch press as claimed in claim 11 wherein:

said punch holder cartridge means comprises two parallel rows of punches with the punches in each row staggered with respect to the punches in the other row; and, said die holder cartridge means comprises two rows of dies aligned with the associated punches in said punch holding cartridge means.

14. A punch press as claimed in claim 11 comprising:

a second punch head mechanism supported on said frame spaced apart from said punch head mechanism disposed to engage and operate punches supported by said punch holding cartridge mean.

15. A punch press as claimed in claim 12 wherein:

said punch head mechanism comprises a large eccentric crank which during a punching operation causes the operated punch to project through the work table plane for less than 183 degrees of rotation of said crank.

16. A punch press as claimed in claim 15 wherein:

during operation the punch is withdrawn above the work table plane for sufficient time to permit the workpiece to be moved to another position providing for continuous nibbling.

17. A punch press as claimed in claim 11 wherein:

an opening is formed in at least one side of the punch press to permit said punch cartridges and said die cartridges to pass therethrough;

said punch driver section can position all punch cartridges thru said opening outside of the punch press; and, said die driver section can position all die cartridges thru said opening outside of the punch press.

18. A punch press as claimed in claim 11 wherein:

an angled way guide is provided on one side only of the cartridge support.

19. A punch press for operating on a sheet metal workpiece comprising:

a bridge type main frame which spans a punching area;

a punch head mechanism disposed on said bridge type main frame above the punching area;

a workpiece positioning table extending from the punching area for supporting the worksheet;

a two axes positioning mechanism disposed for positioning the worksheet at desired location in the punching area;

an elongated linear punch holding cartridge assembly movable on said bridge type frame above the punching area having two parallel rows of punches disposed thereon, each row aligned with the direction of movement of said cartridge assembly, with the axes of the punches in each row staggered with respect to the axes of the punches in the other row;

connecting means for connecting said punch head mechanism to a selected punch for a punching operation, said connecting means including a member having a pair of features aligned with a respective one of said rows and aligned with each other along a direction normal to said rows, each of said features engageable with each punch in a respective row upon being positioned thereover, the opposite feature from that feature aligned over a punch being not engageable with any of the said punches due to said staggered relationship of said rows; and, a mating, die holding cartridge assembly mechanism disposed beneath said punch holding cartridge assembly and being positioned with the punch holding cartridge so the appropriate die is in position during a punching operation.

20. A punch press as claimed in claim 19 wherein:

said connecting means features comprise a pair of slotted T-shaped openings formed therein through which T-shaped members attached to the tops of the punches pass as the linear punch-holding cartridge is moved and depending on the position at which the linear punch-holding cartridge is stopped engages a punch in one of the two parallel rows.

21. A punch press as claimed in claim 20 comprising:

a plurality of index openings formed on one side of said linear punch holding cartridge;

a punch index pin disposed to engage the appropriate opening to accurately align said linear punch holding cartridge before punching;

a plurality of index openings formed on one side of said linear die holding cartridge; and, a die index pin disposed to engage the proper opening to accurately align said linear die holding cartridge before punching.

22. A punch press as claimed in claim 19 comprising:

a second punch head mechanism disposed on said bridge type frame spaced apart from said first punch head mechanism by the length of one punch cartridge; and, a second connecting means disposed to connect the second punch head mechanism to a desired punch during a punching operation.

23. A punch press comprising:

a bridge type press frame spanning an elongated workpiece area wherein a workpiece is located during a punching operation;

a table frame attached at one end to said bridge frame;

a work table supported from said table frame for supporting a workpiece;

a carriage extending across and movable along said work table in a Y-axis direction;

a cross slide supported from and movable along said carriage in an X-axis direction;

a first pair of worksheet grippers supported from and movable with said cross slide in an X-axis direction;

a primary punch head mechanism disposed on said bridge type press frame above the workpiece area;

a plurality of punches supported in a punch holding assembly from said bridge type press frame;

connecting means for connecting a selected punch to said primary punch head mechanism;

a plurality of dies supported in a die holding assembly from said bridge type press frame beneath said punch holder, one of said dies to work in conjunction with the selected punch on a workpiece disposed there between;

a secondary punch head mechanism disposed on said bridge type press frame spaced apart in the X-axis direction from said primary punch head mechanism and supported above the workpiece area; and, second connecting means for connecting a second selected punch to said secondary punch head mechanism.

24. A punch press as claimed in claim 23 wherein:

said punch holding assembly comprises removable punch cartridge sections which are joined together for unitary movement;

said die holding assembly comprises removable die cartridge sections which are joined together for unitary movement; and, said secondary punch head mechanism is spaced from said primary punch head mechanism by the length of a punch cartridge section.

25. A punch press as claimed in claim 24 comprising:

a disappearing table which is engaged and positioned by the last die cartridge section.

26. A punch press as claimed in claim 23 comprising:

an unloading table attached to said bridge type press frame on the side opposite the table frame; and, means for tilting said unloading table for automatic unloading of a workpiece.

27. A punch press as claimed in claim 23 comprising:

a second pair of worksheet grippers, spaced apart from said first pair of worksheet grippers, supported from and movable along said carriage.

* * * * *